US008025352B2

(12) United States Patent
Edamura et al.

(10) Patent No.: US 8,025,352 B2
(45) Date of Patent: Sep. 27, 2011

(54) INK JET PRINTING APPARATUS AND INK JET PRINTING METHOD

(75) Inventors: Tetsuya Edamura, Kawasaki (JP); Kiichiro Takahashi, Yokohama (JP); Minoru Teshigawara, Yokohama (JP); Akiko Maru, Tokyo (JP); Yoshiaki Murayama, Tokyo (JP); Takatoshi Nakano, Tokyo (JP); Hiroshi Taira, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 537 days.

(21) Appl. No.: 12/188,803

(22) Filed: Aug. 8, 2008

(65) Prior Publication Data

US 2009/0046124 A1 Feb. 19, 2009

(30) Foreign Application Priority Data

Aug. 14, 2007 (JP) ..... 2007-211473

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS 5,818,474 A 10/1998 Takahashi et al.
6,042,212 A 3/2000 Takahashi et al.
6,102,537 A * 8/2000 Kato et al. ..... 347/101
6,206,502 B1 3/2001 Kato et al.
6,454,390 B1 9/2002 Takahashi et al.
6,532,026 B2 3/2003 Takahashi et al.
6,601,939 B2 8/2003 Fujita et al.
6,779,873 B2 8/2004 Maeda et al.
7,284,823 B2 10/2007 Nishikori et al.

FOREIGN PATENT DOCUMENTS

JP 2000-108322 A 4/2000

* cited by examiner

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

An ink jet printing apparatus is provided which is capable of producing an image with a good balance between image quality and printing speed, without unduly shortening a longevity of a print head, even when an odd-numbered-pass bidirectional printing is performed. To this end, during a bidirectional multi-pass printing with a relatively small number of passes, a stepping mask is used to eliminate image problems caused by a difference in print permitted ratio between forward scan and backward scan. During a bidirectional multi-pass printing with a relatively large number of passes, a flat mask is used to give priority to suppressing density unevenness resulting from nozzle characteristic variations. As a result, the printing apparatus as a whole can produce an image with a good balance between image quality and printing speed, without unduly shortening a longevity of the print head.

12 Claims, 19 Drawing Sheets

| | FAST | STANDARD | FINE |
|---|---|---|---|
| PLAIN PAPER | 1 PASS | 1 PASS | 4 PASS |
| GLOSSY PAPER | 3 PASSES | 5 PASSES | 7 PASSES |
| COATED PAPER | 3 PASSES | 5 PASSES | 7 PASSES |

FIG.17

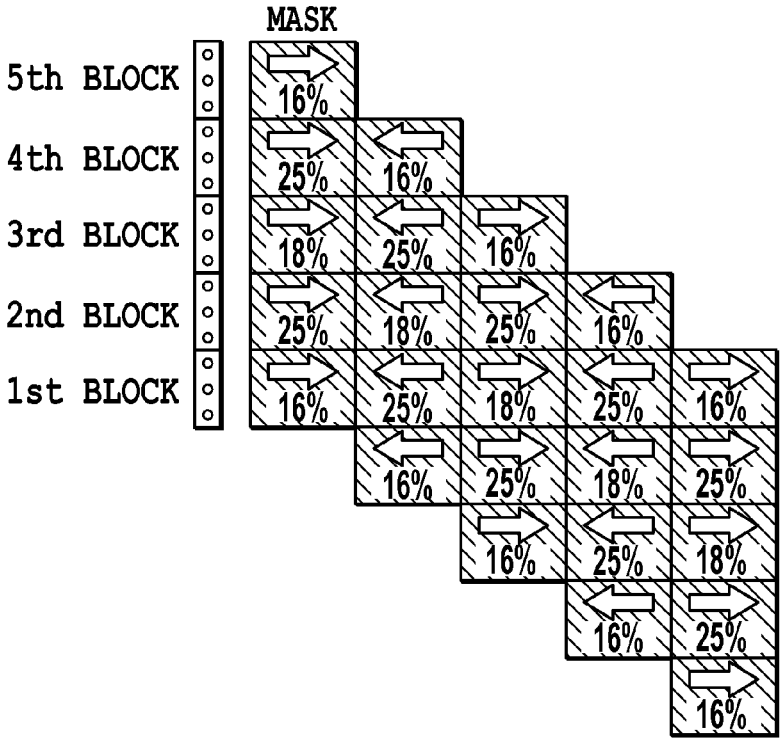

| | |
|---|---|
| FORWARD (16%) + BACKWARD (25%) + FORWARD (18%) + BACKWARD (25%) + FORWARD (16%) | FORWARD 16%×2+18% =50%<br>BACKWARD 25%×2 =50% |
| BACKWARD (16%) + FORWARD (25%) + BACKWARD (18%) + FORWARD (25%) + BACKWARD (16%) | FORWARD 25%×2 =50%<br>BACKWARD 16%×2+18% =50% |
| FORWARD (16%) + BACKWARD (25%) + FORWARD (18%) + BACKWARD (25%) + FORWARD (16%) | FORWARD 16%×2+18% =50%<br>BACKWARD 25%×2 =50% |
| BACKWARD (16%) + FORWARD (25%) + BACKWARD (18%) + FORWARD (25%) + BACKWARD (16%) | FORWARD 25%×2 =50%<br>BACKWARD 16%×2+18% =50% |
| FORWARD (16%) + BACKWARD (25%) + FORWARD (18%) + BACKWARD (25%) + FORWARD (16%) | FORWARD 16%×2+18% =50%<br>BACKWARD 25%×2 =50% |

FIG.18

INK JET PRINTING APPARATUS AND INK JET PRINTING METHOD

BACKGROUND OF THE INVENTION

1. Field of the Invention

The present invention relates to an ink jet printing apparatus and an ink jet printing method. More specifically it relates to a multi-pass printing method commonly employed in serial type printing apparatus.

2. Description of the Related Art

In recent years, relatively inexpensive office automation devices such as personal computers and word processors have come into widespread use. At the same time, efforts are being made to develop various types of printing apparatus that output information supplied from these devices and to enhance printing speed and print quality of these printing apparatus. Among others, a serial type ink jet printing apparatus is drawing attention as a relatively small printing apparatus capable of producing prints at low cost at high speed or with high quality. Such a serial type ink jet printing apparatus can perform a bidirectional printing to produce an image at high speed or perform a multi-pass printing to produce an image with high quality. Brief descriptions are made in the following as to the bidirectional printing and multi-pass printing in the serial type ink jet printing apparatus.

(Bidirectional Printing)

In a serial type ink jet printing apparatus, a print head having an array of ink drop ejection nozzles integrally formed therein is mounted in a carriage that is moved in a main scan direction in the printing apparatus. Individual nozzles (or ejection ports) of the print head eject ink according to image data as the carriage is moved, to form one band of image. A printing main scan (also referred to simply as a printing scan) of one band and an operation to convey a print medium corresponding to one band width are alternated repetitively to form an image on the print medium progressively.

The bidirectional printing is a printing method that, after completing a forward printing scan and the subsequent print medium convey operation, performs a printing scan in the backward direction without executing a back scan. Compared with a one-way printing that repeats the process of performing the back scan followed by the printing scan, the bidirectional printing can shorten the printing time. For example, suppose an entire area of the A4-size print medium is to be printed using a print head that has 64 nozzles arrayed therein at a density of 360 dpi (dots/inch) in the print medium convey direction. This requires about 60 printing scans. In that case, while the one-way printing requires about 60 reciprocal scans including back scans, the bidirectional printing needs only about 30 such reciprocal scans to complete the printing. This means the bidirectional printing can produce an image at almost twice the speed of the one-way printing.

(Multi-Pass Printing)

In a printing operation using a print head having a plurality of nozzles, the quality of an image produced is affected by ejection characteristics of individual nozzles. In a process of manufacturing nozzles of the print head, there inevitably occur some variations in the heating characteristics of electrothermal transducers (heaters) installed in the nozzles that generate ejection energy and also in the shape of ejection openings. These variations influence the ejection volume and direction of ink ejected from the nozzles, which in turn generates density unevenness and stripes in an image formed on a print medium.

FIGS. 1A-1C show a printing state of a print head that has no ejection characteristic variations. In the figures, reference number 201 represents a print head which, for the sake of simplicity, is shown to have only eight nozzles 202 here. As shown in FIG. 1A, if the sizes and the ejection directions of ink droplets 203 ejected from nozzles are aligned, an arrangement of dots formed on a print medium and a printed dot density distribution in the direction of nozzle array are uniform, as shown in FIG. 1B and FIG. 1C respectively.

FIGS. 2A-2C show a printing state of a print head that has ejection characteristic variations. The sizes and ejection directions of ink droplets ejected from individual nozzles 202 vary as shown in FIG. 2A. The dot arrangement on a print medium is also not uniform, as indicated in FIG. 2B. It is seen that there are some areas where dots overlap each other more than necessary and also blank areas where an area factor is less than 100%. As a result, the density distribution in the direction of nozzle array is uneven, as shown in FIG. 2C. These non-uniform areas, if repeated in the sub-scan direction, are recognized as density unevenness.

FIGS. 3A-3C show a printing state when a multi-pass printing is done using the print head of FIGS. 2A-2C. As shown in FIG. 3A, the multi-pass printing completes a printing operation on an area that in a one-pass printing can be printed in a single printing scan, by dividing the printing scan into a plurality of printing scans. Here is shown a 2-pass printing method.

FIGS. 4A-4C show an arrangement of dots printed by the individual nozzles in three consecutive printing scans. FIG. 4A shows dots printed in the first printing scan. Here is shown about half the number of dots to be printed in this area of print medium and they are arranged on alternate pixels in vertical and horizontal directions. After the first printing scan, the print medium is conveyed half the printing width of the print head (equivalent to 4 dots in this case) in the sub-scan direction. In the subsequent second printing scan the remaining half of the dots that are also arranged on alternate pixels are again printed (FIG. 4B). It is noted that they are printed at positions complementary to those dots printed in the first printing scan, i.e., they are printed where dots were not printed in the first printing scan. After another 4-dot conveying operation is finished, about half the dots are again printed in the third printing scan at positions complementary to those dots printed in the second printing scan (FIG. 4C). By repeating the above printing scan and the conveying operation alternately, an image is formed on the same image area (each unit image area) on a print medium by two printing scans of different parts of the print head.

The multi-pass printing described above prevents the dots printed by one nozzle from being connected in line in the main scan direction as shown in FIG. 2B. That is, the multi-pass printing allows the use of a print head equivalent to the print head 201 of FIG. 2A and can still halve adverse effects the ejection characteristic variations among the nozzles on the print medium image, with a resultant dot arrangement being as shown in FIG. 3B. As a result, the density distribution in the nozzle alignment direction is almost uniform as shown in FIG. 3C.

FIG. 7 is a schematic diagram for explaining a mask pattern capable to use for 2-pass printing and a completing relationship of it. P0001 denotes nozzle group consist of 8 nozzles for ejecting ink of same color. The nozzle group is divided into a first block and a second block each including 4 nozzles. P0002A and P0002B denote mask patterns corresponding to the first block and the second block respectively and each mask pattern has 4 pixels×4 pixels area. P0002A (lower pattern in FIG. 7) is a mask pattern used for a first scan, and P0002B (upper pattern in FIG. 7) is a mask pattern used for a second scan. Each mask pattern (P0002A and P0002B) consist of arrangement of print permitted pixels indicated by black and print non-permitted pixels indicated by white. Mask pattern P0002A for the first scan and Mask pattern P0002B for the second scan have completing relationship each other. Therefore, superimposing them, all of 4 pixels×4 pixels area is filled, and up to 100% printing become possible. Then, as such mask pattern is used repeatedly for the main scan direction, 2-pass printing becomes possible for all of area where the print head scans.

Next, the "print permitted pixel" and the "print non-permitted pixel" will be described. The "print permitted pixel" means a pixel in which a dot is permitted to be printed. That is, when a 2-value image data corresponding to the "print permitted pixel" indicates ejecting ink, a dot is printed to the pixel. And when the 2-value image data indicates not-ejecting ink, a dot is not printed to the pixel. On the other hand, the "print non-permitted pixel" means a pixel in which a dot is not permitted to be printed regardless of the 2-value image data. That is, even if the 2-value image data corresponding to the "print non-permitted pixel" indicates ejecting ink, a dot is not printed to the pixel.

P0003 and P0004 denote an arrangement of dots in an image which is completed by 2-pass printing. In the first scan, 2-valued image data generated by using mask pattern P0002A is printed by the first block. Then, the print medium is conveyed, in the direction of an arrow, by a distance corresponding to width of one block. In the following second scan, in a similar way, 2-valued image data generated by using mask pattern P0002A is printed by the first block. At the same time, in the second scan, 2-valued image data generated by using mask pattern P0002B is printed by the second block. In this way, a printing for an area corresponding to half of nozzle arraying region capable to be use in a 2-pass printing mode, is completed by 2 times printing scans.

Although in the above explanation dots have been described to be arranged at alternate pixels in both vertical and horizontal directions in each printing scan, the multi-pass printing is not limited to such a dot arrangement. The positions in which dot is printed in each printing scan are generally determined by an arrangement of print permitted pixels of the mask pattern described above. It is therefore possible to adjust the dot arrangement and the print ratios by changing the arrangement and ratio of print permitted pixel in the mask pattern. It is noted that, the "print permitted ratio" defined by a mask pattern is a ratio, which is expressed in percentage, of a number of print permitted pixels of a total number of the print permitted pixels and print non-permitted pixels in the mask pattern.

The 2-pass printing has been described in the above. The multi-pass printing may increase the number of passes to 2, 3, and 4 passes to enhance the uniformity of image quality. An increase in the number of passes, however, results in a reduction in the printing speed. So, many printing apparatus has a plurality of print modes with different number of passes, such as one that gives priority to image quality and one that places importance on printing speed. By using the bidirectional printing described earlier, it is possible to strike a balance between the image quality and the printing speed to provide a more appropriate print mode. It should, however, be noted that when a bidirectional multi-pass printing is performed using an odd number of passes in, a new problem that does not emerge in a multi-pass printing with an even number of passes arises.

FIGS. 5A and 5B are schematic diagrams showing a difference between an even-numbered-pass printing (with 4 passes) and an odd-numbered-pass printing (with 3 passes).

The bidirectional printing performs a printing operation in both the forward scan and backward scan. If the print heads for a plurality of inks are parallelly arranged in the main scan direction, the order in which the inks are applied to a print medium during the backward scan is reversed to that of the forward scan. For example, if during a forward scan inks are applied in the order of black, cyan, magenta and yellow, the backward scan applies inks in the order of yellow, magenta, cyan and black. At this time, even if the plurality of ink colors are ejected in the same percentages in both the opposite scans to produce the same image colors, there inevitably occurs some color difference between an image obtained in the forward scan and an image obtained in the backward scan. Further, if the printing is done using a single color or the print heads for a plurality of ink colors are arranged in the sub-scan direction, some printing characteristic differences, such as differences in dot shape resulting from satellite landing position variations, emerge between the forward scan and the backward scan. As a result, there are some density differences between images formed in the forward scan and the backward scan.

Thus, even where the multi-pass printing is performed, it is desired that there be no difference in the number of dots between the forward scan and the backward scan. Take FIG. 5A for example. In the case of an even-numbered-pass printing with four passes, the forward and backward scans are executed two times each for the same image area of a print medium which is corresponding to a conveying distance of the print medium between scan and scan. Therefore, if the each printing scans for the same image area is given a print permitted ratio of 25%, the total print percentage of the forward scans and that of the backward scans are both 50%.

However, in the case of 3-pass printing shown in FIG. 5B, the numbers of times that the forward scan and the backward scan are executed over the same image area of a print medium (corresponding to a conveying distance of the print medium between scan and scan) are not equal. Image areas printed by two forward scans and one backward scan and image areas printed by one forward scan and two backward scans are alternated in the sub-scan direction. That is, if the print permitted ratio for each printing scan is set at approximately-same, then image areas with a strong printing characteristic of forward scan where the number of dots printed by the forward scan is 33.3% more than that of the backward scan and image areas with a strong backward scan printing characteristic where the number of dots printed by the backward scan is 33.3% more than that of the forward scan, are formed alternately. Since colors and densities may differ between these two kinds of image areas, overall image impairments such as color unevenness and density unevenness are likely to occur.

As to the bidirectional printing with an odd number of passes, Japanese Patent Laid-Open No. 2000-108322 discloses a construction in which a print permitted ratio is differentiated according to nozzle positions in the print head in order to make the sum of print permitted ratio in forward scans and the sum of print permitted ratios in backward scans equal.

FIG. 6 is a schematic diagram showing print permitted ratios of forward scans and backward scans in 3-pass bidirectional printing disclosed in Japanese Patent Laid-Open No. 2000-108322. According to this patent document, a nozzle array of the print head is divided into three blocks, with both side blocks used in a first pass and a third pass for a same image area assigned a print permitted ratio of 25% each and a central block used in a second pass assigned a print permitted ratio of 50%. With this, areas printed by forward scan followed by backward scan followed by forward scan and areas printed by backward scan followed by forward scan followed by backward scan can both have equal numbers of dots capable to be printed by the forward scans and the backward scans.

In the following, a mask pattern in which the print permitted ratio of at least one scan is different from that of other scans, as described with FIG. 6, is referred to as a stepping mask. On the other hand, a mask that sets print permitted ratio of different scans substantially equal, such as shown in FIGS. 5A and 5B, is referred to as a flat mask.

With the above stepping mask, it is possible to produce a uniform printed image with no color unevenness or density unevenness even when an odd-numbered-pass printing is performed.

When the stepping mask is used, however, a difference of printing frequency is arisen among nozzles. So, if any nozzle greatly differing in ejection volume and ejection direction from other should be included in the neighboring nozzles having high, frequency of use the ejection characteristics of that nozzle is easily recognized on a printed image. That is, the use of the stepping mask may pose a risk of eliminating the advantage the multi-pass printing is intended to produce—that of "alleviating the adverse effect of image due to ejection characteristics of individual nozzles".

Another problem in using the stepping mask is that the print head longevity may be reduced by a shortened life of a nozzle having a high frequency of use.

SUMMARY OF THE INVENTION

The present invention has been accomplished to overcome the problems described above. It is therefore an object of this invention to provide an ink jet printing apparatus that can produce an image with an appropriate balance of image quality and printing speed, without unduly shortening the life of a print head, even if an odd-numbered-pass printing is performed.

In a first aspect of the present invention, there is provided an ink jet printing apparatus capable of performing a bidirectional printing for printing an image on a print medium by ejecting ink from a print head in which a plurality of nozzles are arranged during forward and backward movements of the print head, the apparatus comprising: an executing unit capable of executing at least a first print mode for performing the bidirectional printing in accordance with a first mask pattern by M movements (M is an odd number equal 3 or more) between which the print medium is conveyed by a first conveying distance smaller than a length of a region on which the plurality of nozzles are arranged, and a second print mode for performing the bidirectional printing in accordance with a second mask pattern by N movements (N is an odd number larger than M) between which the print medium is conveyed by a second conveying distance smaller than the first conveying distance, wherein a difference between a maximum value and a minimum value of print permitted ratios, defined by the first mask pattern, for the M movements is larger than a difference between a maximum value and a minimum value of print permitted ratios, defined by the second mask pattern, for the N movements.

In a second aspect of the present invention, there is provided an ink jet printing apparatus capable of performing a bidirectional printing for printing an image on a print medium by ejecting ink from a print head in which a plurality of nozzles are arranged during forward and backward movements of the print head, the apparatus comprising: an executing unit which is capable of executing selectively a plurality of print modes for performing the bidirectional printing on an area of the print medium by K movements (K is an odd number equal 3 or more) between which the print medium is conveyed by a distance smaller than a length of a region on which the plurality of nozzles are arranged, the plurality of print modes having different K, and mask patterns that are used for the plurality print modes, to divide an image data to be printed to the area into a plurality of pieces of image data corresponding to K movements, wherein in a print mode of relatively-small K, a mask pattern, in which a difference between a maximum value and a minimum value of print permitted ratios for the K movements is set to be relatively-large, is used, and in a print mode of relatively-large K, a mask pattern, in which the difference is set to be relatively-small, is used.

In a third aspect of the present invention, there is provided an ink jet printing method capable of performing a bidirectional printing for printing an image on a print medium by ejecting ink from a print head in which a plurality of nozzles are arranged during forward and backward movements of the a print head, the method comprising the steps of: selecting one print mode to be executed from a plurality of print modes including at least a first print mode for performing the bidirectional printing in accordance with a first mask pattern by M movements (M is an odd number equal 3 or more) between which the print medium is conveyed by a first conveying distance smaller than a length of a region on which the plurality of nozzles are arranged, and a second print mode for performing the bidirectional printing in accordance with a second mask pattern by N movements (N is an odd number larger than M) between which the print medium by a second conveying distance smaller than the first conveying distance, and executing the one print mode selected by the selecting step, wherein a difference between a maximum value and a minimum value of print permitted ratios, defined by the first mask pattern, for the respective M movements is larger than a difference between a maximum value and a minimum value of print permitted ratios, defined by the second mask pattern, for the respective N movements.

In a fourth aspect of the present invention, there is provided an printing system including a printing apparatus and an image processing device for supplying an image data to the printing apparatus, the printing apparatus being capable of performing a bidirectional printing for printing an image on a print medium by ejecting an ink from a print head in which a plurality of nozzles arrayed during forward and backward movement of the print head, the system comprising: setting unit which sets one print mode from a plurality of print modes for executing the bidirectional printing on an area of the print medium by K movements (K is an odd number equal 3 or more) between which the print medium is conveyed by a distance smaller than a nozzle arrayed region in which of the plurality of nozzles are arranged, the plurality of print modes having different K, and mask patterns used for the plurality print modes capable to be set by the setting unit, which is for dividing an image data to be printed to the area into image data corresponding to K movements, wherein in a print mode of relatively-small K, a mask pattern, in which a difference between maximum value and minimum value of a print permitted ratios for the K movements is set to be relatively-large, is used and in a print mode of relatively-large K, a mask pattern, in which the difference is set to be relatively-small, is used.

Further features of the present invention will become apparent from the following description of exemplary embodiments (with reference to the attached drawings).

BRIEF DESCRIPTION OF THE DRAWINGS

FIG. 17 illustrates nine print modes available in the embodiment of this invention; and FIG. 18 is a schematic diagram showing print permitted ratios for forward scan and backward scan in a 5-pass printing in an embodiment of this invention.

DESCRIPTION OF THE EMBODIMENTS

Now, embodiments of this invention will be explained in detail.

First Embodiment

Figure 8:
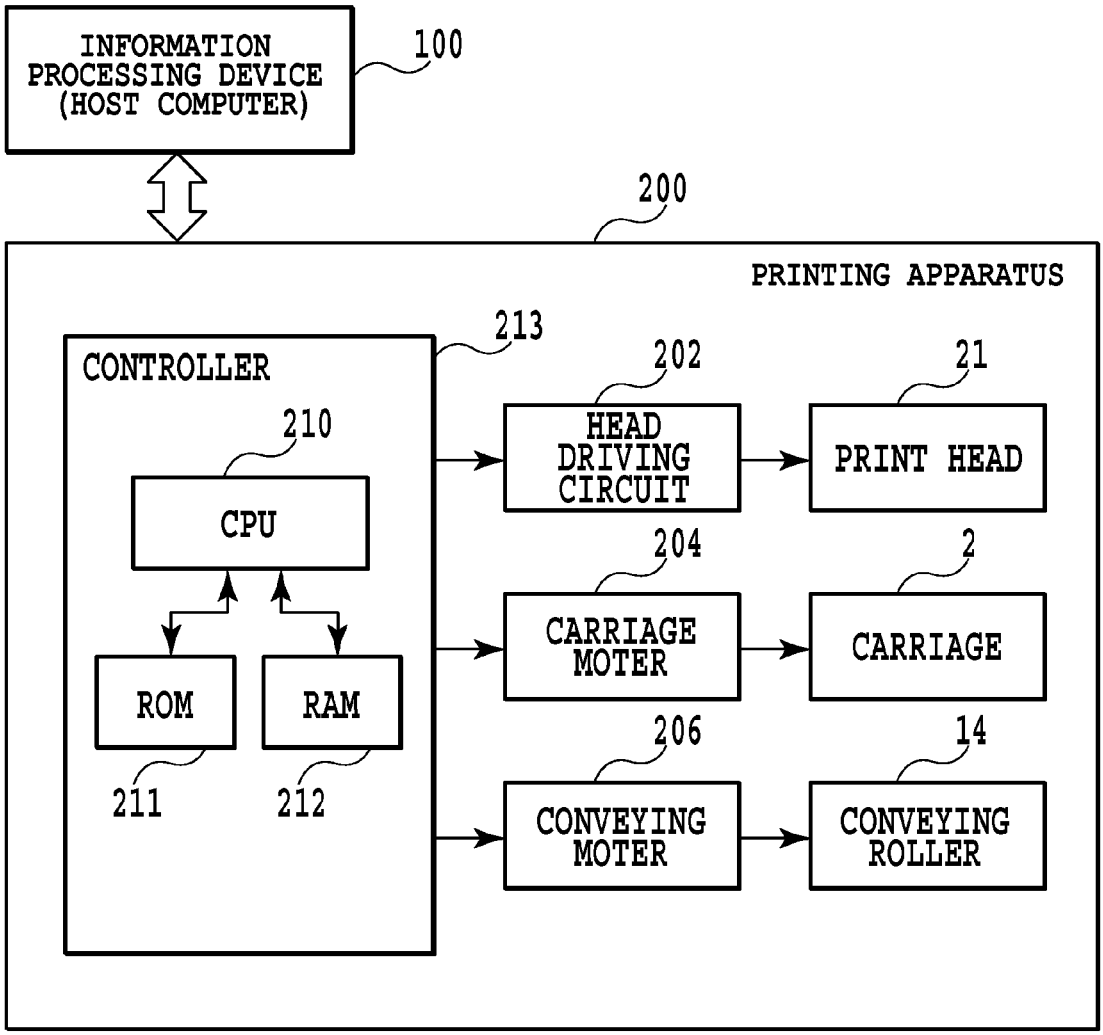
FIG. 8 is a block diagram showing a control construction of printing system which includes a printing apparatus and an information processing device (host computer) in an embodiment of this invention.

FIG. 8 is a block diagram showing a control construction of printing system which includes a printing apparatus 200 and an information processing device (host computer) 100 in this embodiment. Denoted 200 is an ink jet printing apparatus that ejects ink from a print head to perform printing. Designated 100 is an information processing device that has functions of supplying image data to the ink jet printing apparatus 200 and controlling it. The printing apparatus 200 and the information processing device 100 are connected to a known communication means (interface) for mutual communication. The information processing device 100, according to instructions from the user, generates image data to be supplied to the printing apparatus 200 and causes the printing apparatus 200 to execute a printing operation based on the image data. By using the information processing device, user can select one print mode from a plurality of print mode which can be performed in the printing apparatus 200 and can set it. In this embodiment, as discussed below, one print mode is selectively set from the plurality of print mode according to a combination of "kind of printing medium" and "printing quality" selected by user. Then, the information about print mode set in the information processing device 100 is transmitted to the printing apparatus 200. In the printing apparatus 200, a printing mode to be performed is set based on the information transmitted.

K-pass bidirectional print modes (K is an odd number equal to 3 or more), such as 3-pass, 5-pass, 7-pass printing, are included in the plurality of print modes can be performed in the printing apparatus. The K-pass bidirectional print mode is a print mode in which a bidirectional printing by K scan of print head is performed for an area having a width corresponding to a conveying distance of the print medium: each scan being performed between conveying operations by a distance small than a width of the nozzle arraying region. In a 3-pass print mode, for example, by three scans of print head, an image is printed in an area having one third width of a nozzle arraying region wherein nozzles capable to be used in the 3-pass print mode: each of the scans being performed between conveying operations by a distance corresponding to the one third width of the nozzle arraying region. Additionally, in 5-pass print mode, by five scans of print head, an image is printed in an area having one fifth width of nozzle arraying region wherein nozzles capable to be used in the 5-pass print mode: each of the scans being performed between conveying operations by a distance corresponding to the one fifth width of the nozzle arraying region.

Figure 15A:
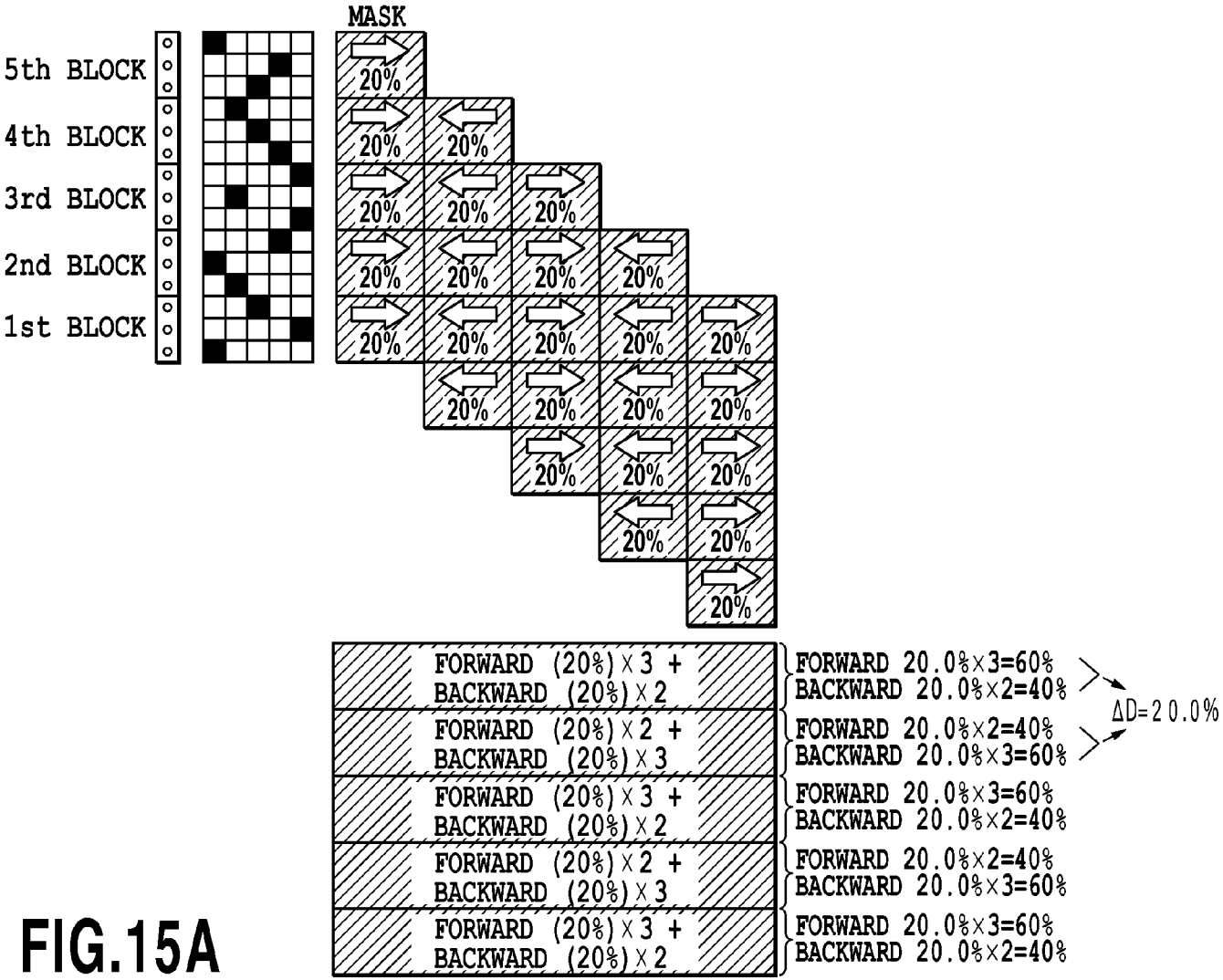
FIGS. 15A and 15B are schematic diagrams showing print permitted ratios for forward scan and backward scan of a 5-pass printing and a 7-pass printing in the embodiment of this invention.
Figure 15B:
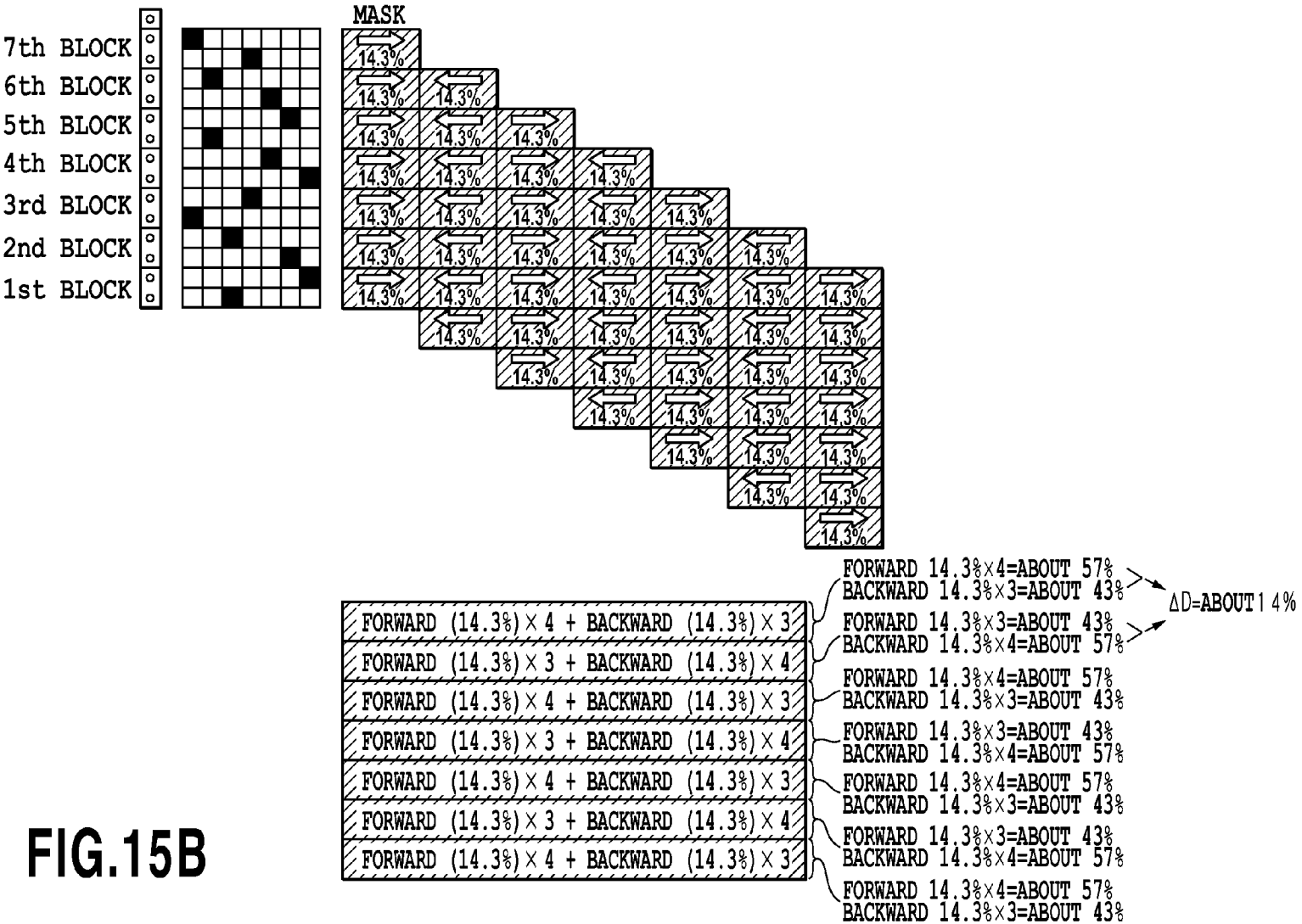

In the printing apparatus 200, controller 213, print head 21, head driving circuit 202, carriage 2, carriage motor 204, conveying roller 14, conveying motor 206 and the like are provided. The head driving circuit 202 is for driving the print head 21 to eject an ink from it. The carriage motor 204 is a motor for causing a carriage 2 mounting the print head 21 in it to move reciprocatelly. The conveying motor 206 is a motor for causing the conveying roller 14 to convey the printing medium. In the controller 213 for controlling all of the apparatus, CPU 210 having a configuration of a micro processing unit, ROM 211 in which control programs are stored, RAM 212 used by the CPU 210 for processing an image data, and the like are provided. In ROM 211, a plurality kind of mask patterns corresponding to a plurality of print mode (e.g. mask patterns showed in FIGS. 6 and 15) and control programs for controlling the multi-pass printing are stored. Controller 213 sets one print mode to be executed according to an information about print modes transmitted from the information processing apparatus 100. Additionally, controller 213 controls the head driving circuit 202, carriage motor 204 and conveying motor 206 to execute a multi-pass printing and generates an image data corresponding to each printing scan of the multi-pass printing. For details, the controller 213, according to the control program, divides an image data corresponding to a same image area (predetermined area) to generate image data corresponding to each printing scan by using the mask pattern read out from the ROM 211. Furthermore, controller 213 controls the head driving circuit 202 causing the print head 21 to eject an ink according to the divided image data.

Figure 9:
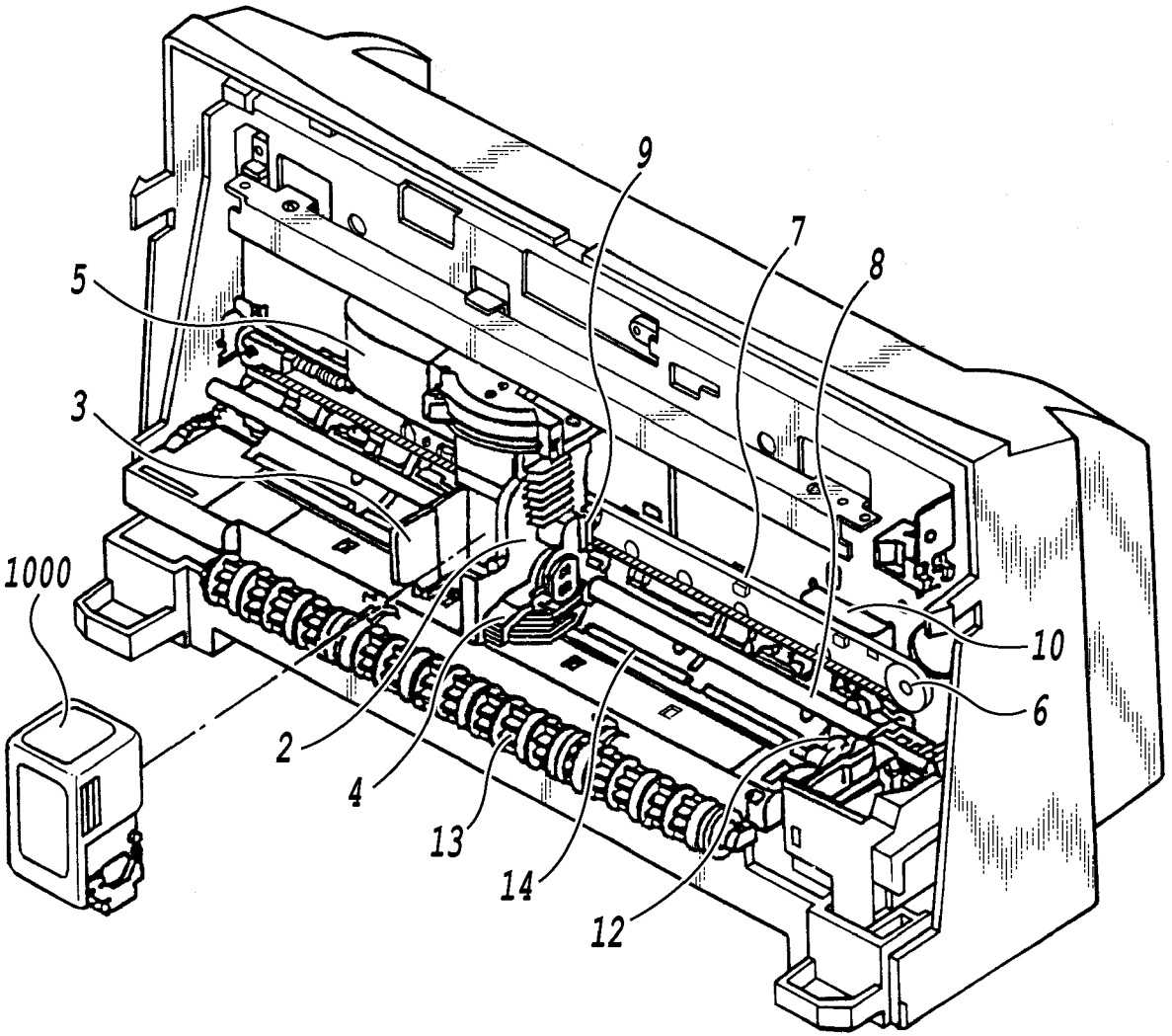
FIG. 9 is a perspective view showing an internal structure of an ink jet printing apparatus that can apply the present invention.

FIG. 9 is a perspective view showing an internal structure of an ink jet printing apparatus that can apply the present invention. In the figure, denoted 1000 is a replaceable head cartridge, which comprises a print head 21 to eject ink and an ink tank for supplying ink to the print head 21. Denoted 2 is a carriage on which the head cartridge 1000 is replaceably mounted. Reference number 3 represents a holder to securely hold the head cartridge 1000 to the carriage 2. With the head cartridge 1000 mounted in the carriage 2 and held by the holder 3, a cartridge fixing lever 4 is operated to push the head cartridge 1000 against the carriage 2. This pushing action positions the head cartridge 1000 in its place, at the same time bringing a signal transmission contact in the carriage 2 into contact with an electric contact on the head cartridge 1000 side. Reference number 5 represents a flexible cable to transmit electric signals to the carriage 2.

Denoted 6 is a pulley which is linked to a carriage motor that drives the carriage 2 forwardly and backwardly in the main scan direction. Denoted 7 is a carriage belt to transmit the drive force to the carriage 2. A guide shaft 8 extends in the main scan direction and supports and guides the carriage 2. A transmissive photocoupler 9 is attached to the carriage 2. Denoted 10 is a light shielding plate installed near the home position. When the carriage 2 reaches the home position, the light shielding plate 10 interrupts a light beam of the photocoupler 9, detecting that the carriage 2 is at the home position. Denoted 12 is a home position unit that includes some recovery system such as a cap member capping a front of the print head, a suction means to suck out ink from an interior of the cap member and a member for wiping the front of the head.

Designated 13 is a discharge roller to discharge a print medium out of the printing apparatus by holding the print medium between it and a spur roller not shown. A conveying roller conveys the print medium a predetermined distance in the sub-scan direction. When multi-pass print mode is executed, a conveying operation is performed between scan and scan of the print head, wherein a conveying distance of the print medium is dependent on the pass number of the multi-pass printing. As the pass number is larger the conveying distance of one conveying operation is smaller.

Figure 10:
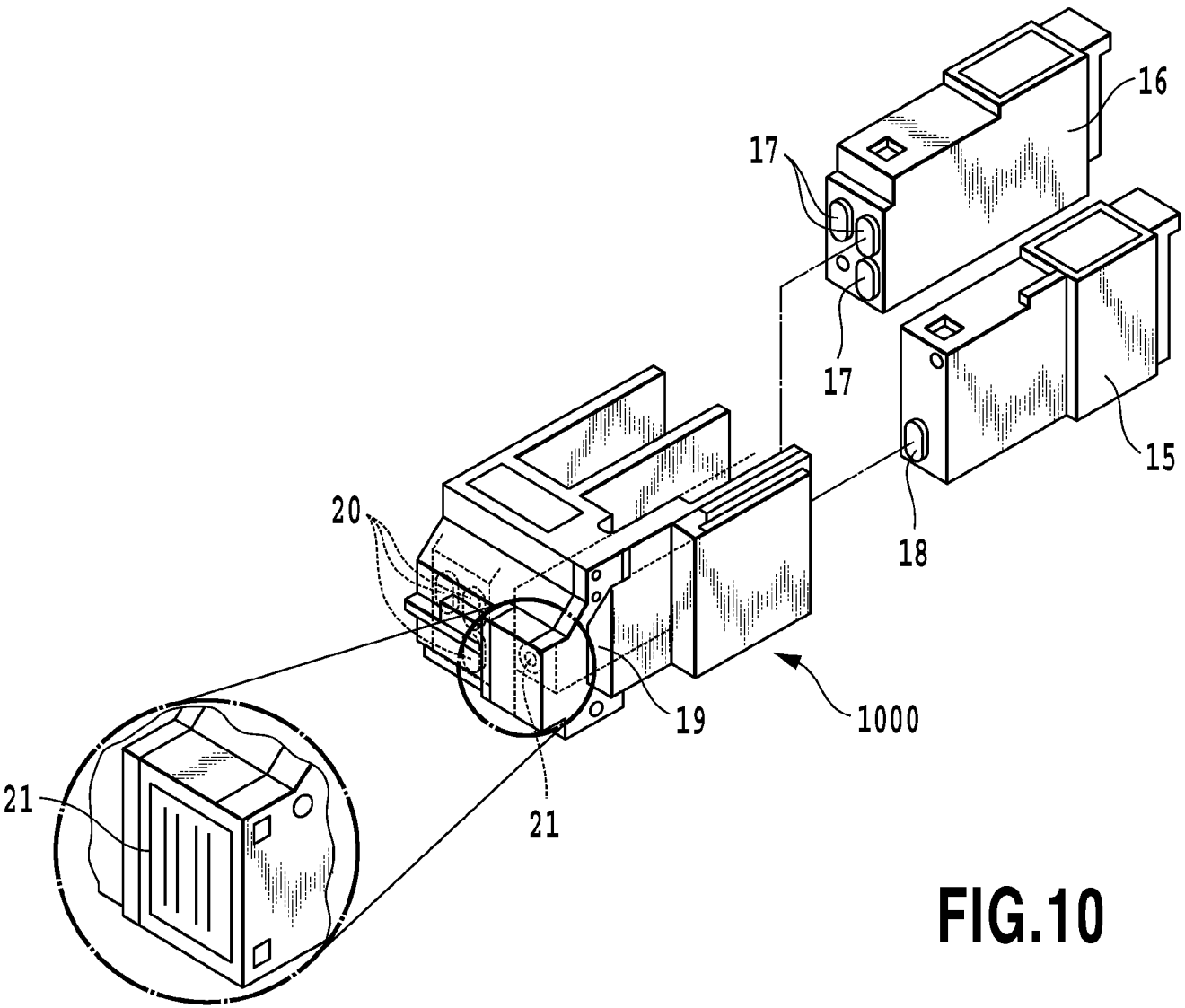
FIG. 10 is a perspective view showing details of a head cartridge.

FIG. 10 is a perspective view showing details of the head cartridge 1000. In FIG. 10, denoted 15 is a replaceable ink tank for Bk (black) ink. Denoted 16 is a replaceable ink tank for C (cyan), M (magenta) and Y (yellow) inks. Designated 17 are ink supply ports of the ink tank 16 that are connected to the head cartridge 1000 to supply ink to it. Similarly reference number 18 represents an ink supply port of the ink tank 15. The ink supply ports 17 and 18 are connected to supply pipes 20 to supply inks to the print head 21. An electric contact 19 is connected to the flexible cable 5 to transmit signals based on the print data to the print head 21.

In FIG. 10, four lines shown on the front face of the print head 21 represent four arrays of ink ejection nozzles, that eject Bk (black) ink, C (cyan) ink, M (magenta) ink and Y (yellow) ink respectively.

Figure 11:
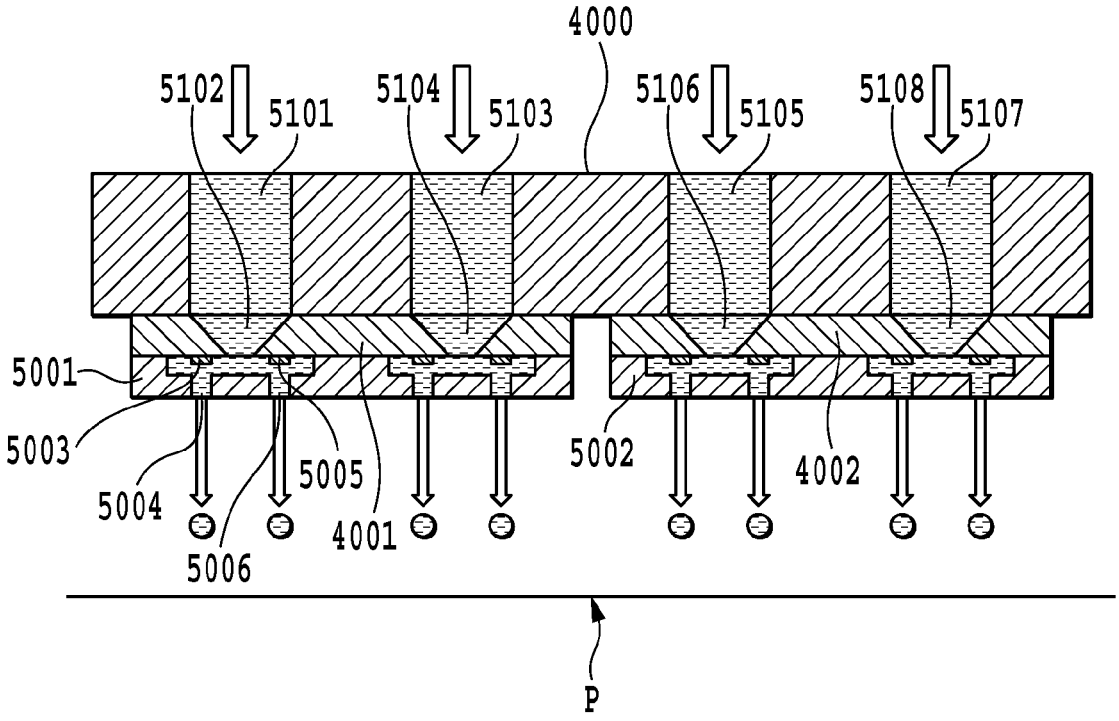
FIG. 11 is a schematic side cross-sectional view showing a nozzle structure in a print head.

FIG. 11 is a schematic side cross-sectional view showing a nozzle construction in the print head 21. Denoted 5102, 5104, 5106 and 5108 are common liquid chambers that accommodate respective color inks and correspond to black, cyan, magenta and yellow ink in that order. The common liquid chambers 5102-5108 are formed in the back of heater boards 4001, 4002, that are fabricated with a semiconductor process, with an anisotropic etching. The common liquid chambers 5102-5108 communicate with a group of liquid paths (5004 and 5006) corresponding to a group of heaters (5003 and 5005). In the ink supplied to individual liquid paths a bubble is generated by a rapid energization of the heater triggered by the print signal. The bubble generation energy expels an ink droplet of a predetermined volume from an ejection opening of a nozzle toward the print medium P. In this specification, an ink ejection element made up of one heater, one liquid path and one ejection opening is referred to as a nozzle.

Although in FIG. 10 four nozzle arrays are shown to be arranged on the print head 21, the actual print head of this embodiment, as shown in FIG. 11, supplies inks of the same color from one common liquid chamber to the two nozzle arrays one on each side of the common liquid chamber. Here, the left side nozzle array 5004 in FIG. 11 is called even-numbered nozzles and the right side nozzle array 5006 is called odd-numbered nozzles. For other ink colors, the similar construction is also employed in the common liquid chamber and the nozzle arrays. Such a construction, however, does not characterize this invention. It does not matter whether the print head has a construction that allows individual color inks to be ejected from corresponding single arrays or whether the print head has only nozzle arrays for black.

5101, 5103, 5105 and 5107 in a base plate 4000 form a part of the common liquid chambers 5102, 5104, 5106, 5108. Denoted 5001 and 5002 are orifice plates formed with nozzles, which are normally made of a heat resistant resin.

Figure 12:
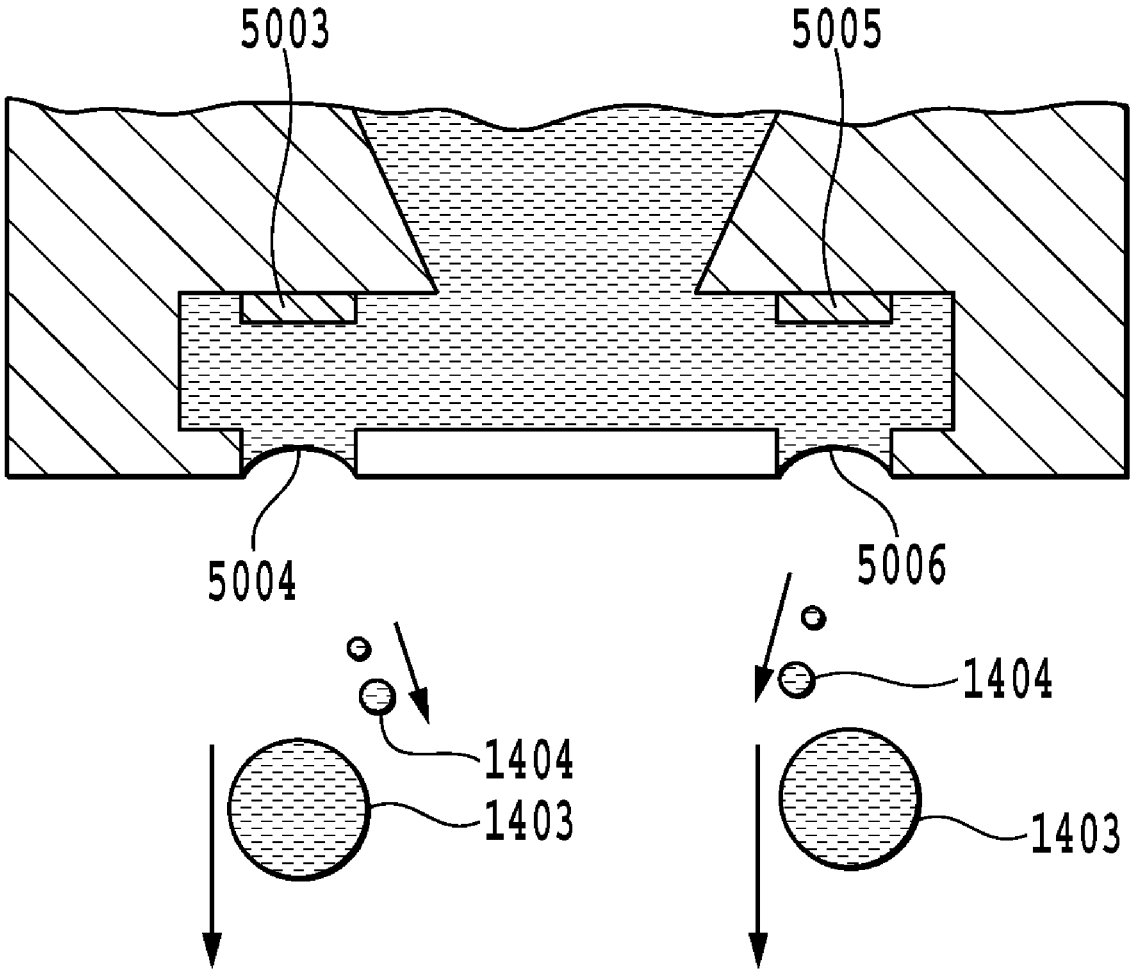
FIG. 12 is an enlarged view showing a structure and an ink ejection state of two nozzle arrays for black ink.

FIG. 12 is an enlarged view showing the structure of two nozzle arrays for black ink and an ink ejection state. Heaters 5003, 5005 are applied a pulse voltage according to a print signal at a predetermined timing. The heaters rapidly heat up, generating a bubble in the nearby ink. At this time, a volume of ink equivalent to the volume of the bubble formed is ejected as an ink droplet from ejection openings in the directions of arrows.

Ink droplets ejected from the nozzles are not always stable as they leave the nozzle opening. So, sub droplets 1404, which are smaller in size and slower in speed than a main droplet 1403, are also often ejected together with the main droplet. Since the print head performs an ejection operation as it moves relative to the print medium, the sub droplets 1404 that are slower than the main droplet 1403 land on the print medium at positions deviated from the main droplet in the forward direction of the main scan, forming small dots—satellites—on the print medium.

Figure 13B:
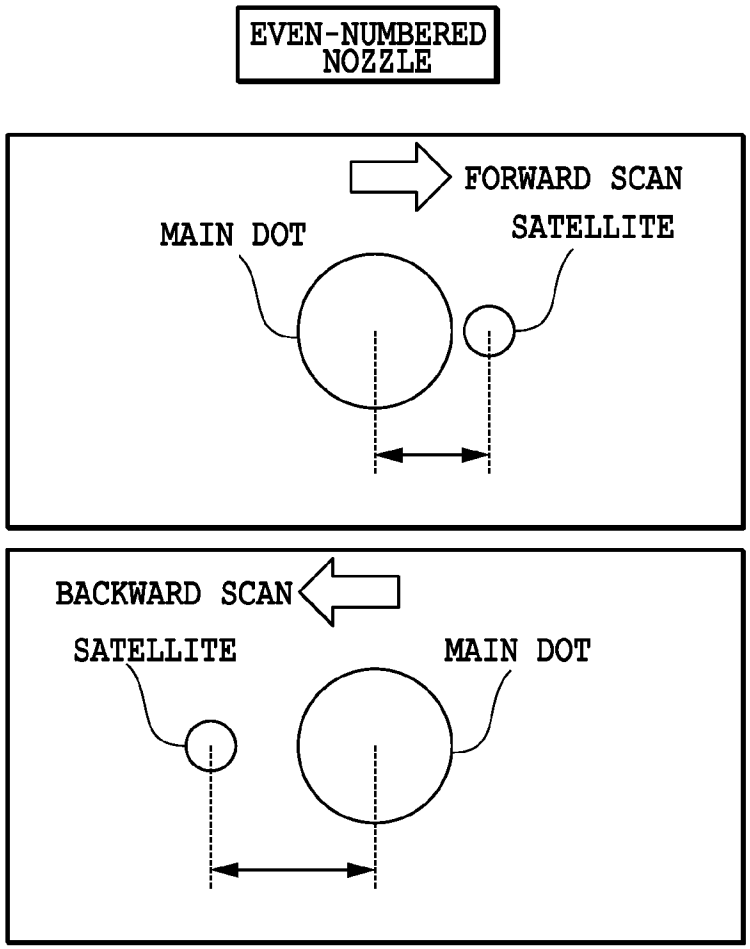
FIGS. 13A and 13B are schematic diagrams showing a positional relation on a print medium between a main dot formed by a main droplet and a satellite.
Figure 13A:
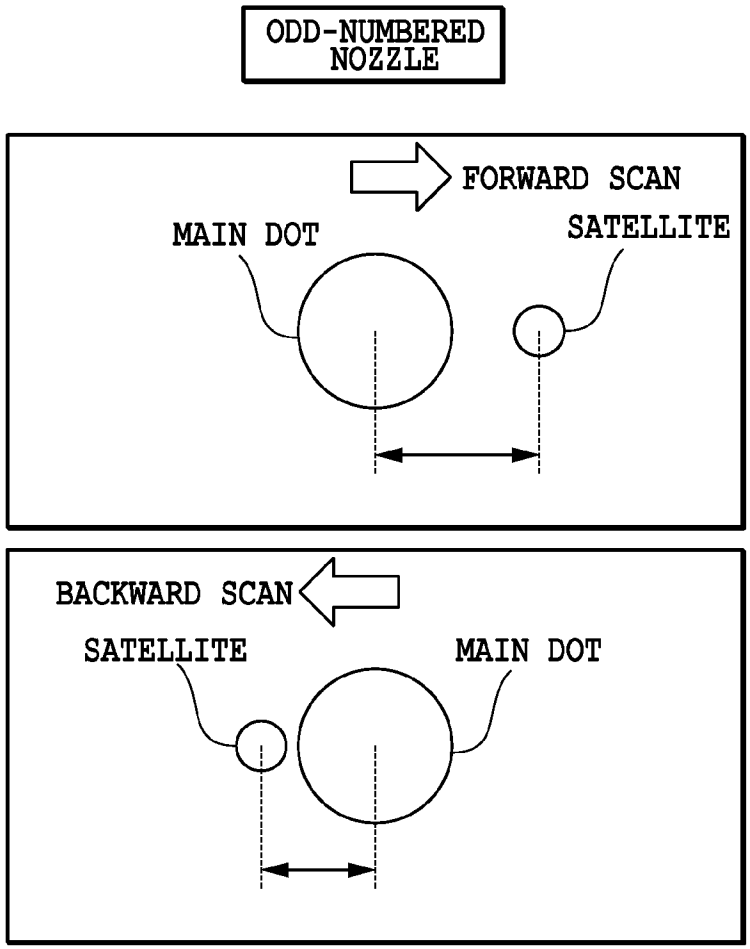

FIGS. 13A and 13B are schematic diagrams showing a positional relation on a print medium between a main dot formed by a main droplet and a satellite. FIG. 13A represents a positional relation between a main dot and a satellite printed by an odd-numbered nozzle, and FIG. 13B represents a positional relation between a main dot and a satellite printed by an even-numbered nozzle. Both figures show a printing state during a forward scan and a printing state during a backward scan, with the position of a satellite with respect to a main dot in the backward scan reversed to that of the forward scan. Further, referring to FIG. 12, since there is some difference in the ejection direction between the main droplet and the sub droplet, the distances of the satellite to the main dot formed by the forward scan and the backward scan are not the same. These influences induce density differences between the forward scan and the backward scan.

Figure 14:
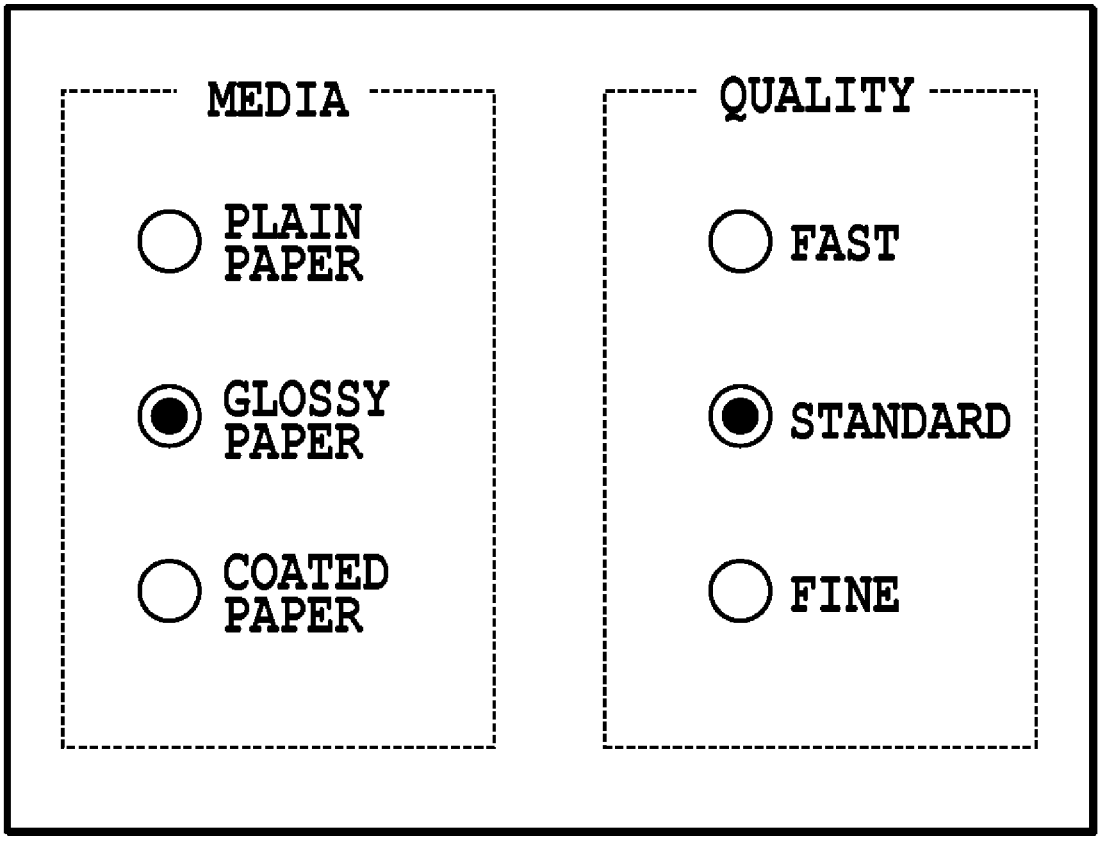
FIG. 14 illustrates a part of a user interface screen an information processing device 100 presents to the user.

FIG. 14 illustrates a part of the user interface screen the information processing device 100 presents to the user. On the interface screen, the user can choose a media to be used (kind of print media) and a print quality. In this example, the print medium can be selected from among glossy paper, coated paper and plain paper. As to the print quality, the user can select from among "fast", "standard" and "fine". By combining a print medium kind and a print quality, one of nine print modes shown in FIG. 17 is set. Setting is made so that the number of passes in the printing operation increases when dedicated paper is chosen rather than plain paper and as a higher print quality is demanded if the same print medium is used.

Figure 1C:
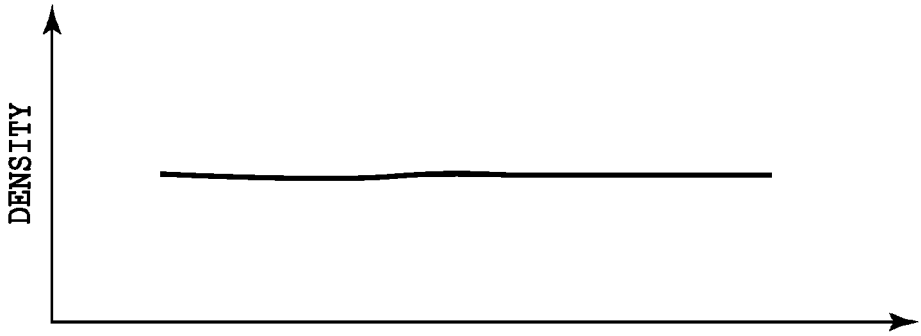
FIGS. 1A-1C are schematic diagrams showing a printing state of a print head with no ejection characteristic variations.
Figure 1B:
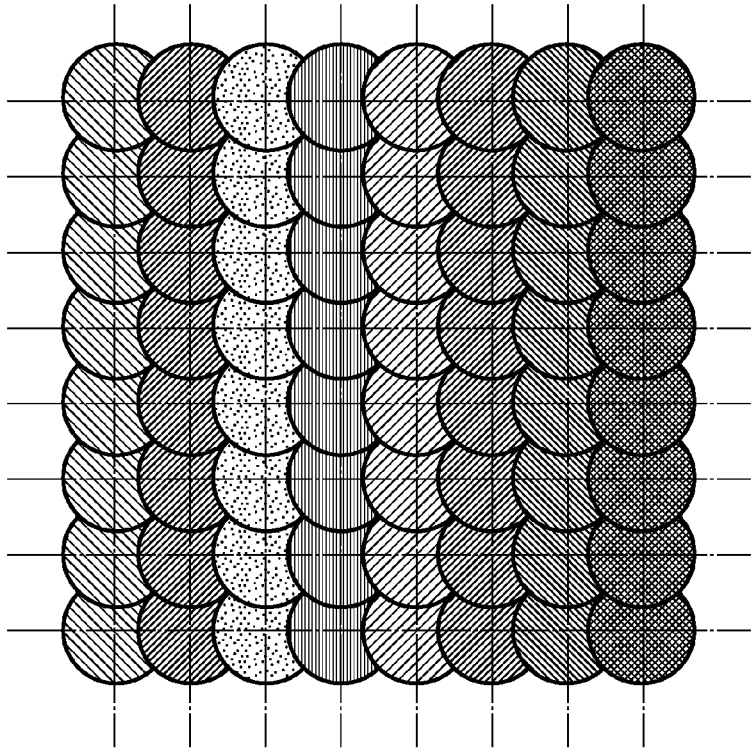
Figure 1A:
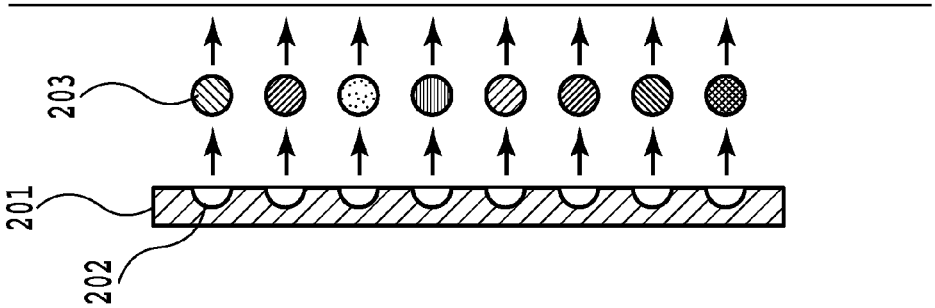
Figure 2C:
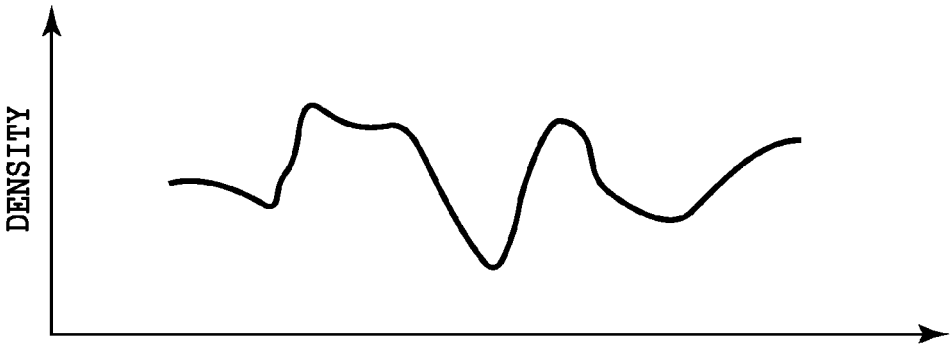
FIGS. 2A-2C are schematic diagrams showing a printing state of a print head with ejection characteristic variations.
Figure 2B:
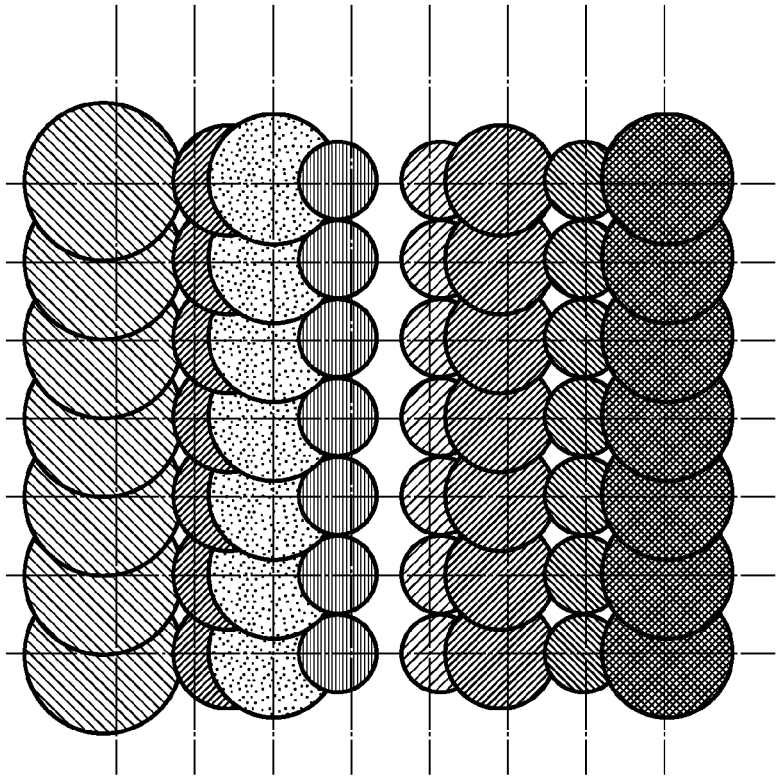
Figure 2A:
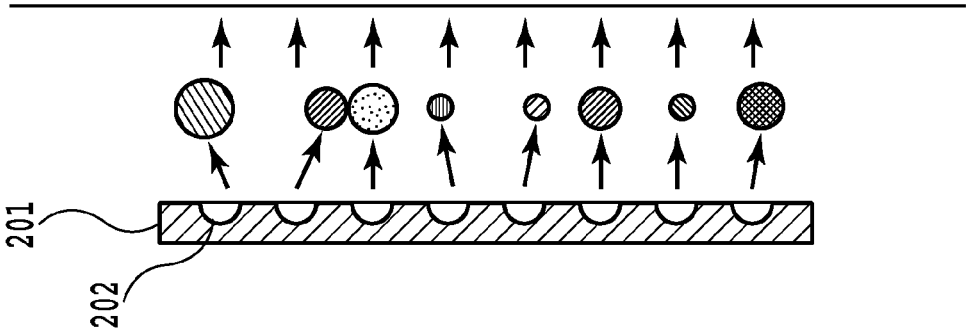
Figure 3C:
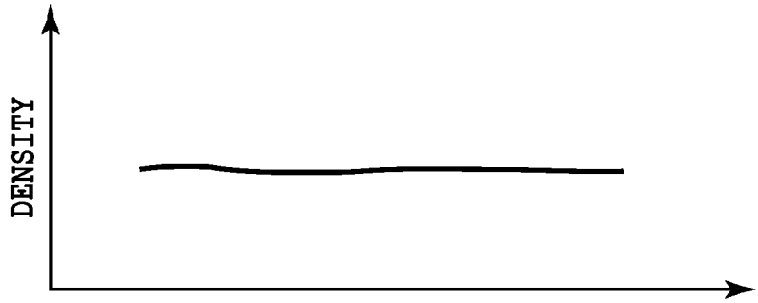
FIGS. 3A-3C are schematic diagrams showing a printing state when a multi-pass printing is performed using the print head of FIGS. 2A-2C.
Figure 3B:
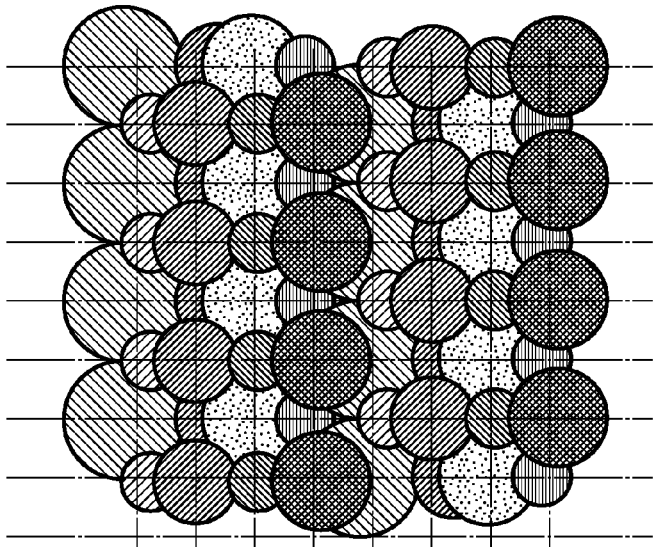
Figure 3A:
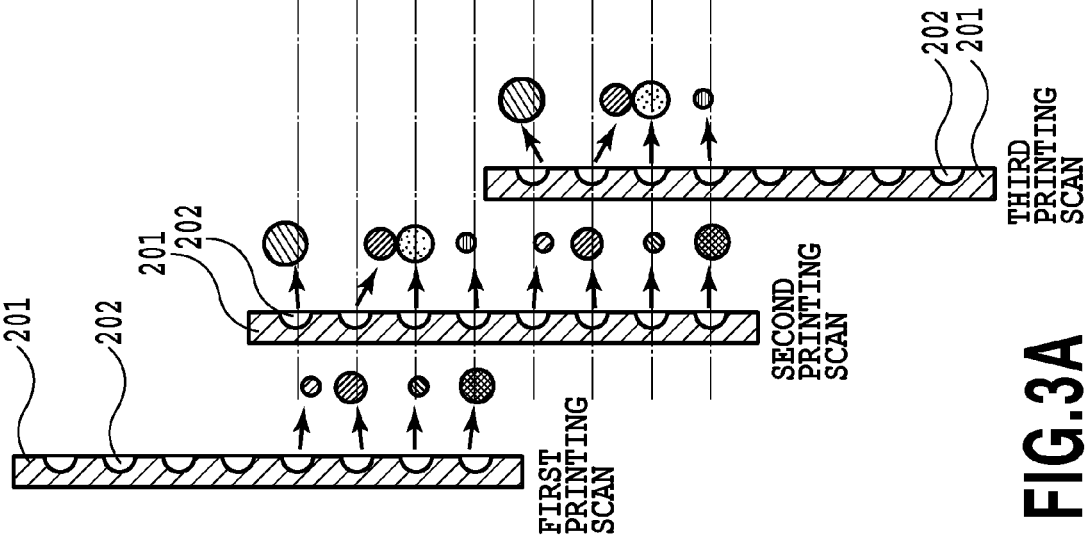
Figure 4A:
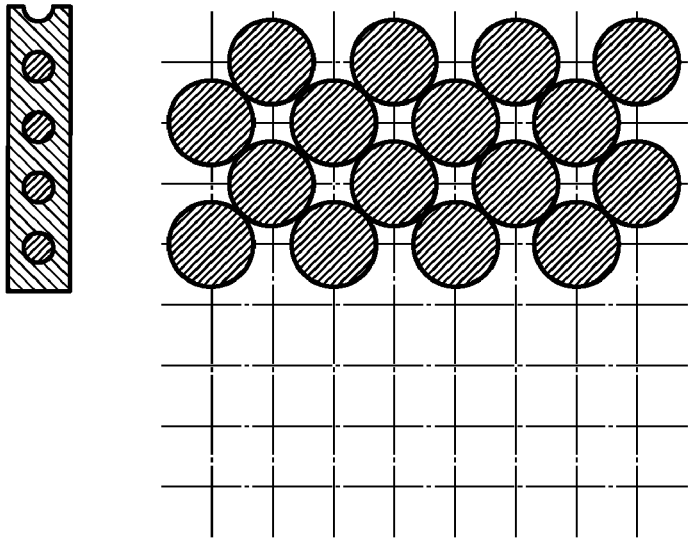
FIGS. 4A-4C are schematic diagrams showing an arrangement of dots printed by nozzles in three consecutive printing scans.
Figure 4B:
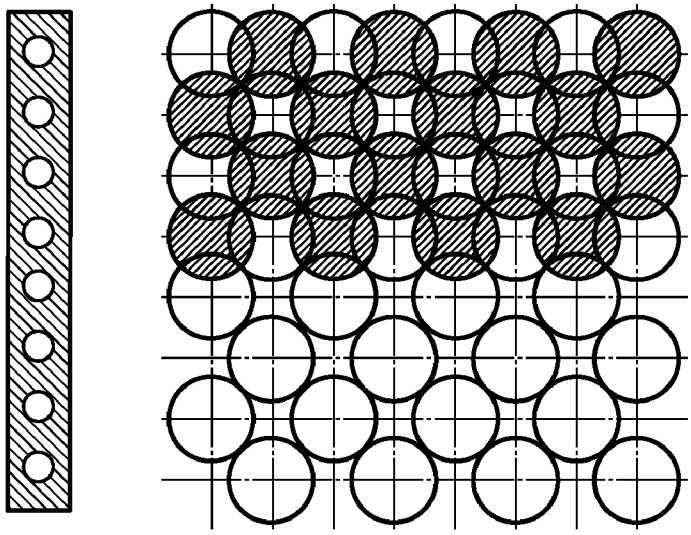
Figure 4C:
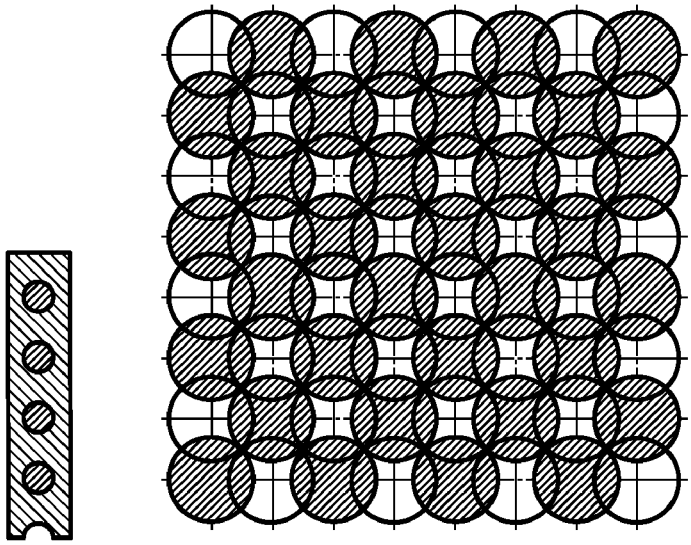
Figure 5B:
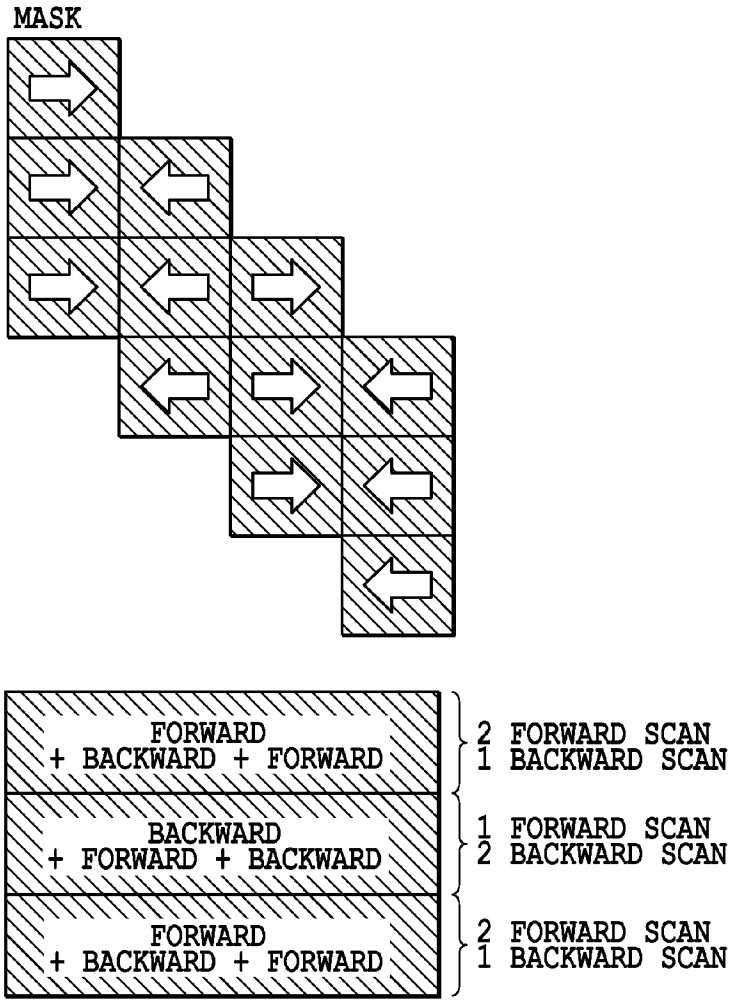
FIGS. 5A and 5B are schematic diagrams showing a difference between an even-numbered-pass printing (with four passes) and an odd-numbered-pass printing (with three passes)
Figure 5A:
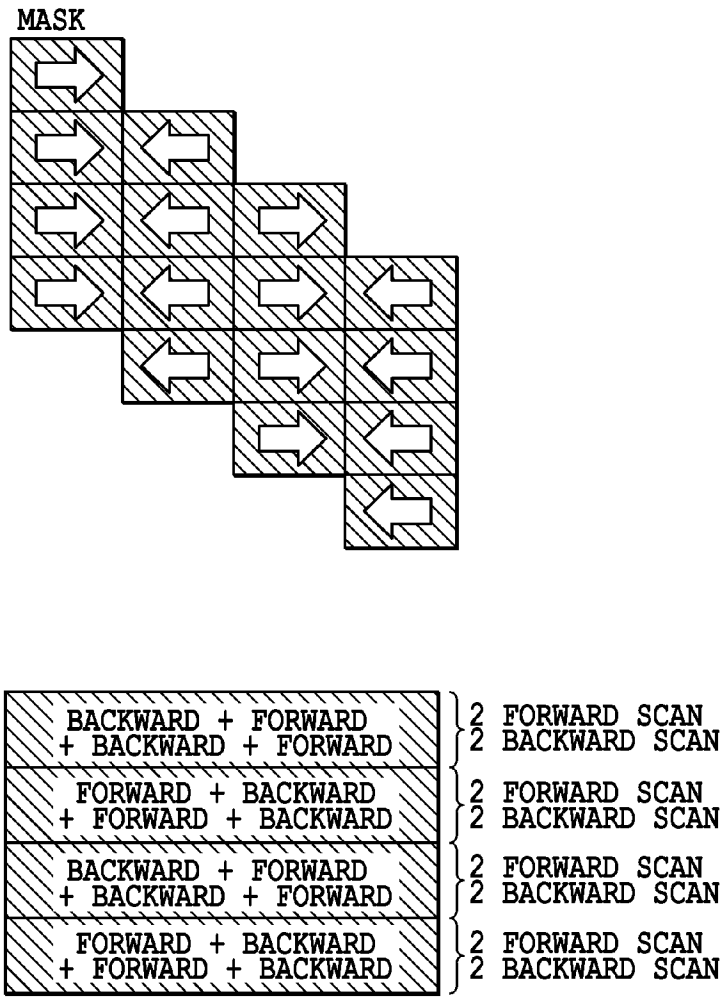
Figure 6:
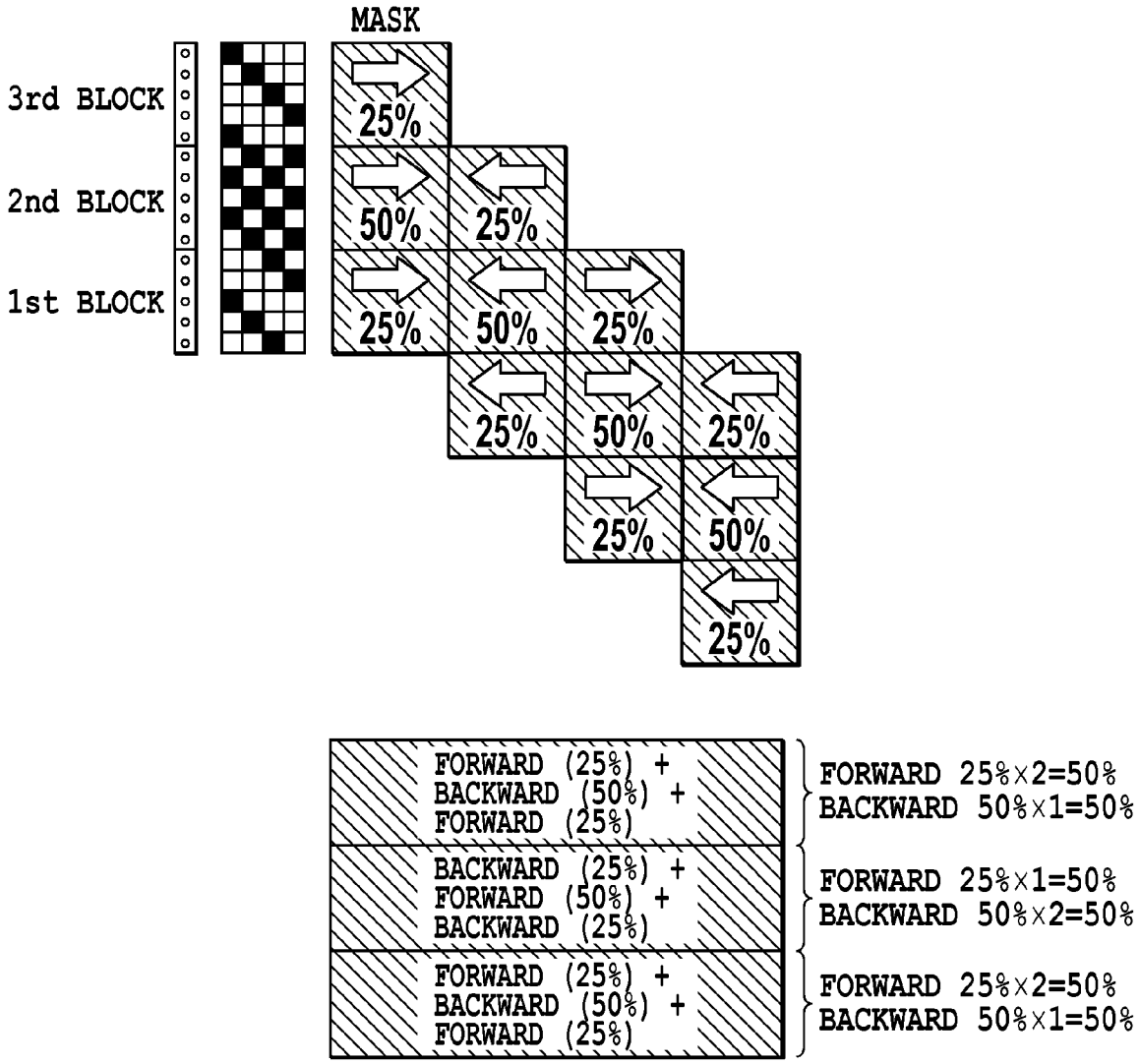
FIG. 6 is a schematic diagram showing print permitted ratios for forward scan and backward scan in a 3-pass printing.
Figure 7:
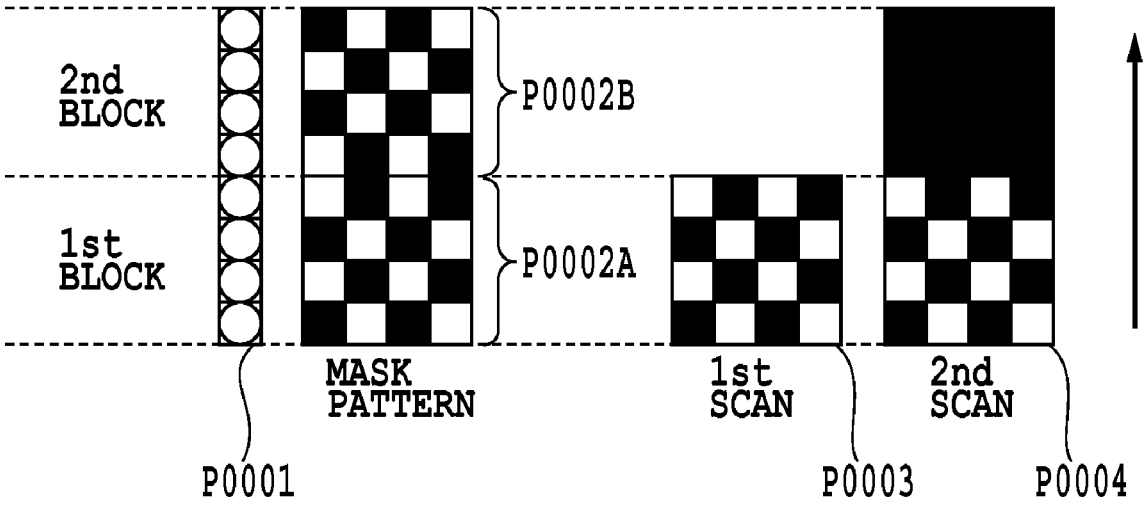
FIG. 7 is a schematic diagram showing a mask pattern used in 2-pass printing.

Multiple kind of K-pass print modes (K is an odd number equal to 3 or more) described above are included in the nine kind of print modes. At least a first print mode and a second print mode are part of the nine kind of print modes. The "first print mode" is a M-pass bidirectional print mode, where M is a relatively-small odd number equal to 3 or more. For example, in the first print mode, an image to be printed in a predetermined area is completed by executing M scans between which the print medium is conveyed by a distance smaller than a nozzle arrayed region (a first conveying distance) using a first mask pattern, as shown in FIG. 6. The first mask pattern is a mask pattern wherein a difference between maximum value and minimum value of the print permitted ratios among M scans is relatively-large. A 3-pass bidirectional print mode is suitable for the first print mode. The "second print mode" is an N-pass print mode, where N is a relatively-large odd number larger than M. For example, in the second print mode, an image to be printed on a predetermined area is completed by executing N scans between which the print medium is conveyed by a distance smaller than the first conveying distance using a second mask pattern, as shown in FIG. 15. The second mask pattern is a mask pattern wherein a difference between a maximum value and a minimum value of the print permitted ratios among N scans is relatively-small. A 5-pass bidirectional print mode or a 7-pass bidirectional print mode is suitable for the second print mode. In this embodiment, M is set to 3 and N is set to 5 or 7, however, M and N are not limited to such values.

A printing method for each print mode will be detailed below. In this embodiment, "fast" and "standard" setting for plain paper do not use a multi-pass printing to give priority to speed. For color images, one-pass unidirectional printing is executed; and for images with only black, one-pass bidirectional printing is executed. If "fine" setting for plain paper is chosen, a 4-pass bidirectional printing is executed using a mask pattern with print permitted ratios of all passes set at approximately 25%.

When "fast" is chosen for glossy paper and coated paper, a 3-pass bidirectional printing corresponding to the first print mode is adopted. A mask pattern (the first mask pattern) employed at this time is a stepping mask explained with reference to FIG. 6. That is, print permitted ratios of the mask pattern for each of three blocks are set to, from one end to the other, 25%, 50% and 25%: the three blocks being made by dividing a nozzle array of 15 nozzles ejecting same kind ink into three. That is, print permitted ratios of 3 scans for the same image area is set so that a first scan is 25%, a second scan is 50% and a third scan is 25%. Therefore both of the print permitted ratio for the forward scans and the print permitted ratio for the backward scans become 50%. As a result, those unit areas (the same image areas) having equal print permitted ratio for both the forward scans and backward scans are arranged consecutively in the conveying direction. This enables color unevenness caused by bidirectional printing and density unevenness caused by misalignment of a satellite to be reduced. As described above, in a 3-pass bidirectional print mode, by using a mask pattern in which the difference between a maximum value and a minimum value of the print permitted ratios among scans is relatively-large, image impairments attributed to a difference of characteristic between forward scan and backward scan is reduced.

When on the other hand "standard" is chosen for glossy paper and coated paper, a 5-pass bidirectional printing corresponding to the second print mode is adopted. A mask pattern (second mask pattern) adopted at this time is a flat mask shown in FIG. 15A. That is, print permitted ratios of the mask pattern for five blocks which is made by dividing a nozzle array of 15 nozzles into five, are set to approximately 20%. In this case, as there is little difference of the print permitted ratios among nozzles, a bias of use frequency of nozzles can be reduced. In case of using a flat mask of 5-pass printing, however, the sum of print permitted ratios for forward scans and the sum of print permitted ratios for backward scans are not equal. As a result, unit areas with the print permitted ratio for the forward scans 20% higher than that for the backward scans and unit areas with the print permitted ratio for the backward scans 20% higher than that for the forward scans are alternately arranged in the sub-scan direction. However, the image impairments (density unevenness due to color unevenness or satellites) caused by odd-number-pass bidirectional printing described above emerge with an increasing distinctiveness as the number of passes decreases. In other words, the image degradation emerge with a decreasing distinctiveness as the number of passes increases. In the case of a 5-pass print mode of relatively-large pass number, even if a flat mask is used, the color unevenness or density unevenness described above is not so distinguished. Therefore, it is effective to reduce a bias of the use frequency of nozzle by adopting a flat mask. As described above, in the 5-pass print mode, a bias of frequency of use of nozzle is reduced by using a mask pattern in which a difference between maximum value and minimum value of the print permitted ratio among passes is small. Meanwhile, the reason why the value of print permitted ratio has represented as "approximately 20%" is that a print permitted ratio may not be just 20% according to a size of a mask pattern. For example, if a size of mask pattern in a scanning direction is multiples of five, the print permitted ratios for 5 scans can be set at just 20%. If that is not multiples of five, however, the print permitted ratios for each scan can not be equal. As there is slight difference depending on a size of a mask pattern, the value of print permitted ratio has represented as "approximately 20%". Obviously, the same applies to other odd-numbered-pass printings.

When "fine" is selected for glossy paper and coated paper, a 7-pass bidirectional printing corresponding to the second print mode is adopted. A mask pattern (second mask) adopted at this time is a flat mask shown in FIG. 15B. In this 7-pass print mode, 14 nozzles are selected from 15 nozzles to capable to be use. Then, print permitted ratios of the mask pattern for 7 blocks, which is made by dividing a nozzle array of 14 nozzles capable to be used into seven, are set to approximately 14.3%. In this case, as there is little difference of print permitted ratio among nozzles, a bias of frequency of use of nozzles is reduced.

In the flat mask for 7-pass, however, the sum of print permitted ratio for forward scans and the sum for print permitted ratio for backward scans are not equal. As a result, unit areas with the print permitted ratio for the forward scans 14.3% higher than that for the backward scans and unit areas with the print permitted ratio for the backward scans 14.3% higher than that for the forward scans are alternately arranged in the sub-scan direction.

In the case of 7-pass printing is performed, which is relatively-large pass mode, even if a flat mask is used the color unevenness or density unevenness described above is not so distinguished. Therefore, it is effective to reduce a bias of frequency of use of nozzle by adopting a flat mask. As described above, in the 7-pass print mode, a bias of frequency of use of nozzle is reduced by using a mask pattern in which a difference between maximum value and minimum value of the print permitted ratio among passes is small.

As described above, in this embodiment when an odd-numbered-pass bidirectional printing is performed, the selection between the stepping mask and the flat mask is switched according to the number of passes that influences a difference in print permitted ratio between the forward scan and the backward scan. That is, if an image problem such as described above is feared, as when a difference in print permitted ratio between the forward scan and the backward scan is great, a stepping mask is employed to give priority to eliminating the image problem described above instead of suppressing the problems of density unevenness caused by nozzle characteristic variations and shortened print head life. If a difference in print permitted ratio between the forward scan and the backward scan is small enough that the above image problem is considered not likely, a flat mask is adopted, giving priority to eliminating the density unevenness resulting from the nozzle characteristic variations and shortened print head life, rather than resolving the image problems described above. That is, a stepping mask is used in odd-numbered-pass bidirectional print modes with a relatively small number of passes; and a flat mask is used in odd-numbered-pass bidirectional print modes with a relatively large number of passes. Therefore, by allowing a plurality of print modes with different target problems to resolve, the printing apparatus as a whole can produce an image with a good balance between image quality and print speed.

In this specification, the "odd-numbered-pass bidirectional printing" means a printing method as shown in FIG. 5, FIG. 6, FIG. 7, FIG. 15, FIG. 16 and the like. More specifically, this represents a printing method that performs a bidirectional printing operation over a same image area (predetermined area) of a print medium with K scans (K is an odd number equal to 3 or more).

As described above, in this embodiment a plurality of print modes each having different K (K is an odd number equal to 3 or more) are made executable selectively. From among these print modes, one print mode to be executed is set and a mask appropriate for the set print mode is selected. More specifically, when the first print mode of small K is set, the first mask (stepping mask) is selected; and when the second mode of large K is set, the second mask (flat mask) is selected. As described above, selecting a mask suitable for the set odd-numbered-pass print mode allows for an image printing with a good balance between image quality and printing speed, without unduly shortening the longevity of the print head.

Second Embodiment

Next, a second embodiment of this invention will be described. The second embodiment is characterized in that it uses a stepping mask for a 3-pass printing different from the one used in the first embodiment. As for the construction of the printing apparatus, it is the same as that of the first embodiment and therefore its explanation is omitted here.

In the first embodiment, an example stepping mask has been described, by referring to FIG. 6, to make the sum of print permitted ratios for forward scans and the sum of print permitted ratios for backward scans equal at 50%. The stepping mask the second embodiment can adopt, however, is not limited to such a configuration. If, as described in the first embodiment, a difference in print permitted ratio between forward scans and backward scans is less than 20% and there is no concern for the image problem described above, a mask pattern may be used that is already adjusted in print permitted ratio to suppress the print permitted ratio difference between the forward scans and the backward scans to less than about 20%. This level of 20% is mere an example, the level can be change according to ink kind, a resolution, landing dispersion and the like.

Figure 16:
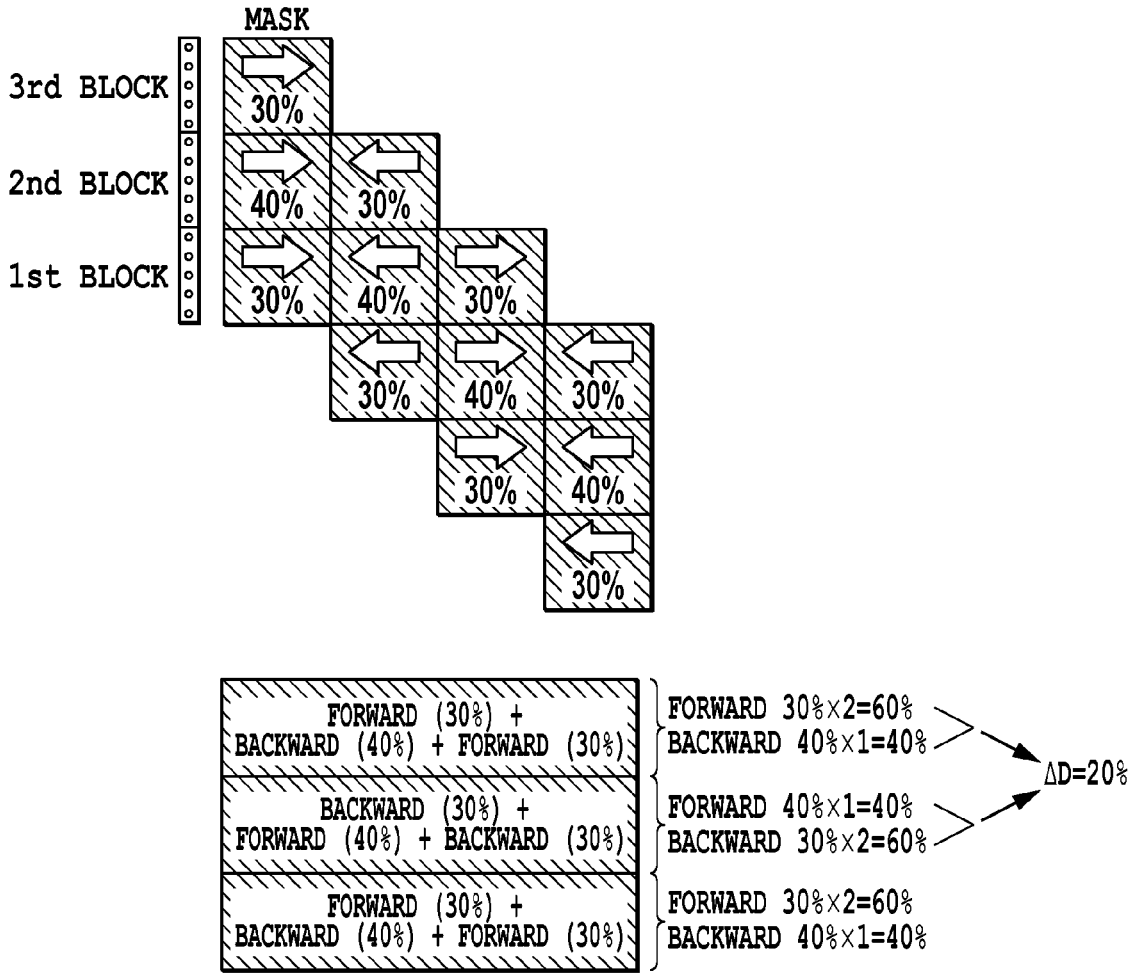
FIG. 16 is a schematic diagram showing another example of print permitted ratios for forward scan and backward scan of a 3-pass printing that can apply the present invention.

FIG. 16 shows one example of such a mask. Here, in a 3-pass bidirectional printing, three divided blocks of a nozzle array are shown to be assigned mask patterns of 30%, 40% and 30%, from one end to the other. When a printing operation is performed using these mask patterns, a difference between the sum of print permitted ratios for forward scans (or backward scans), 60%, and the sum of print permitted ratios for backward scans (or forward scans), 40%, is 20%, which satisfies the above condition. Further, since a difference between maximum value and minimum value of the print permitted ratios among multiple scans (10%) is smaller than that of the 3-pass printing of the first embodiment (25%), the intended effects of the multi-pass printing are more likely to be caused and the print head life less likely to be shortened than the first embodiment.

Third Embodiment

In the first embodiment and second embodiment, a stepping mask is used for a 3-pass print mode and a flat mask is used for a 5-pass or a 7-pass print mode. However, this invention is not limited to this configuration. For example, stepping masks can be used for a 3-pass and for a 5-pass print modes and a flat mask can be used for a 7-pass print mode. The third embodiment is characterized by using a stepping mask for a 5-pass print mode. As for the construction of the printing apparatus, it is the same as that of the first embodiment and therefore its explanation is omitted here.

FIG. 18 shows an example of mask pattern used for a 5-pass printing. Five divided blocks of a nozzle array are shown to be assigned mask patterns of 16%, 25%, 18%, 25% and 18%, from one end to the other. In this mask pattern, a difference between maximum value and minimum value of the print permitted ratio among multiple scans is set to 9% (=25%-18%). In addition, both of a sum of the print permitted ratios for three forward scans and a sum of the print permitted ratios for two backward scans are set to 50%.

As described above, in this embodiment, a stepping mask having a difference value between maximum value and minimum value of the print permitted ratios (9%) smaller than that for the 3-pass printing (25% for the first embodiment, 10% for the second embodiment). For this construction, the larger number of passes is such that 3-pass, 5-pass, 7-pass, the smaller the difference between maximum value and minimum value of the print permitted ratios is. This allows for an image printing with a good balance between reducing image impairment and longevity of the print head.

Other Embodiment

While in the above embodiments a 3-pass print mode, 5-pass print mode and 7-pass print mode are adopted for K-pass print mode (K is an odd number equal 3 or more), the present invention is not limited to this configuration. For example, such as 9-pass print mode, 11-pass print mode and 13-pass print mode may be used as a K-pass print mode.

While in the preceding embodiments the printing apparatus 200 has been described to be connected to the information processing device 100, that the user directly accesses, to form a printing system, the present invention is not limited to this configuration. They may be configured so that the user can directly access the printing apparatus to set a print mode. In that case, the user on an operation panel of the printing apparatus selects from among a plurality of print modes a desired mode to be executed. The selected print mode is then set in the printing apparatus 200. Further, while the mask patterns used in the above embodiments may be stored in a memory (ROM 211) of the printing apparatus 200, they may also be stored in a memory of the information processing device 100. In this case, the mask pattern corresponding to the print mode needs to be transferred to the printing apparatus along with image data; alternatively, data processed by the mask pattern needs to be transferred as print signals for individual scans to the printing apparatus. In either case, as long as a mask having a relatively-large difference between maximum value and minimum value of the print permitted ratio among scans is used in an odd-numbered-pass bidirectional printing with a relatively small number of passes, and a mask having a relatively-small difference between maximum value and minimum value of the print permitted ratios among scans is used in an odd-numbered-pass bidirectional printing with a relatively large number of passes, the system itself falls within a scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2007-211473, filed Aug. 14, 2007, which is hereby incorporated by reference herein in its entirety.

What is claimed is:

1. An ink jet printing apparatus for performing a bidirectional printing for printing an image on a print medium by ejecting ink from a print head in which a plurality of nozzles is arranged during forward and backward movements of the print head, said apparatus comprising:

an executing unit for executing at least a first print mode for performing the bidirectional printing in accordance with a first mask pattern by M movements, where M is an odd number equal to 3 or more, between which movements the print medium is conveyed by a first conveying distance smaller than a length of a region on which the plurality of nozzles is arranged, and a second print mode for performing the bidirectional printing in accordance with a second mask pattern by N movements, N is an odd number larger than M, between which movements the print medium is conveyed by a second conveying distance smaller than the first conveying distance, wherein a difference between a maximum value and a minimum value of print permitted ratios, defined by the first mask pattern, for the M movements is larger than a difference between a maximum value and a minimum value of print permitted ratios, defined by the second mask pattern, for the N movements.

2. The inkjet printing apparatus according to claim 1, wherein in the first print mode, the bidirectional printing is performed by (M+1)/2 forward (or backward) movement and (M−1)/2 backward (or forward) movement, and a sum of print permitted ratios for forward movement and a sum of print permitted ratios for backward movement, which are defined by the first mask pattern, are substantially equal.

3. The inkjet printing apparatus according to claim 1, wherein the print permitted ratios, defined by the second mask pattern, for the N movements are substantially equal.

4. The inkjet printing apparatus according to claim 1, wherein a number of M is 3 and a number of N is 5 or 7.

5. An ink jet printing apparatus for performing a bidirectional printing for printing an image on a print medium by ejecting ink from a print head in which a plurality of nozzles is arranged during forward and backward movements of the print head, said apparatus comprising:

an executing unit which is capable of executing selectively a plurality of print modes for performing the bidirectional printing on an area of the print medium by K movements, where K is an odd number equal to 3 or more, between which movements the print medium is conveyed by a distance smaller than a length of a region on which the plurality of nozzles is arranged, the plurality of print modes having different K, and mask patterns that are used for the plurality print modes, to divide an image data to be printed to the area into a plurality of pieces of image data corresponding to K movements, wherein in a print mode of relatively small K, a mask pattern, in which a difference between a maximum value and a minimum value of print permitted ratios for the K movements is set to be relatively large, is used, and in a print mode of relatively large K, a mask pattern, in which the difference is set to be relatively small, is used.

6. The inkjet printing apparatus according to claim 5, wherein in a print mode in which K is 3, a mask pattern in which the difference is set to relatively large is used and in a print mode in which K is 5 or 7, a mask pattern in which the difference is set to relatively small is used.

7. The inkjet printing apparatus according to claim 5, wherein the plurality of print modes includes three or more print modes, and the greater the value of K the smaller the difference.

8. The inkjet printing apparatus according to claim 5, wherein the print mode of relatively small K is a print mode in which a number of movement of the print head is the smallest in the plurality of print modes.

9. The inkjet printing apparatus according to claim 5, wherein the print mode of relatively large K is a print mode in which a number of movement of the print head is the largest in the plurality of print modes.

10. The inkjet printing apparatus according to claim 5, wherein one print mode to be executed is set among the plurality print modes according to a kind of the print medium and print quality.

11. An ink jet printing method for performing a bidirectional printing for printing an image on a print medium by ejecting ink from a print head in which a plurality of nozzles is arranged during forward and backward movements of the print head, said method comprising the steps of:

selecting one print mode to be executed from a plurality of print modes including at least a first print mode for performing the bidirectional printing in accordance with a first mask pattern by M movements, where M is an odd number equal to 3 or more, between which movements the print medium is conveyed by a first conveying distance smaller than a length of a region on which the plurality of nozzles is arranged, and a second print mode for performing the bidirectional printing in accordance with a second mask pattern by N movements, where N is an odd number larger than M, between which movements the print medium by a second conveying distance smaller than the first conveying distance, and executing the one print mode selected by said selecting step, wherein a difference between a maximum value and a minimum value of print permitted ratios, defined by the first mask pattern, for the respective M movements is larger than a difference between a maximum value and a minimum value of print permitted ratios, defined by the second mask pattern, for the respective N movements.

12. A printing system including a printing apparatus and an image processing device for supplying an image data to the printing apparatus, the printing apparatus for performing a bidirectional printing for printing an image on a print medium by ejecting an ink from a print head in which a plurality of nozzles arrayed during forward and backward movement of the print head, said system comprising:

a setting unit which sets one print mode from a plurality of print modes for executing the bidirectional printing on an area of the print medium by K movements, where K is an odd number equal to 3 or more, between which movements the print medium is conveyed by a distance smaller than a nozzle arrayed region in which of the plurality of nozzles is arranged, the plurality of print modes having different K, and mask patterns used for the plurality of print modes for being set by said setting unit, which is for dividing an image data to be printed to the area into image data corresponding to K movements, wherein in a print mode of relatively small K, a mask pattern, in which a difference between maximum value and minimum value of a print permitted ratios for the K movements is set to be relatively large, is used and in a print mode of relatively large K, a mask pattern, in which the difference is set to be relatively small, is used.

* * * * *